US012084919B2

(12) United States Patent
McDonough et al.

(10) Patent No.: US 12,084,919 B2
(45) Date of Patent: Sep. 10, 2024

(54) HYBRID BIT

(71) Applicant: Schlumberger Technology Corporation, Sugar Land, TX (US)

(72) Inventors: Scott D. McDonough, The Woodlands, TX (US); Venkatesh Karuppiah, The Woodlands, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 118 days.

(21) Appl. No.: 17/595,569

(22) PCT Filed: May 21, 2020

(86) PCT No.: PCT/US2020/033989

§ 371 (c)(1),
(2) Date: Nov. 19, 2021

(87) PCT Pub. No.: WO2020/237046

PCT Pub. Date: Nov. 26, 2020

(65) Prior Publication Data

US 2022/0220807 A1 Jul. 14, 2022

Related U.S. Application Data

(60) Provisional application No. 62/850,619, filed on May 21, 2019.

(51) Int. Cl.
*E21B 10/14* (2006.01)
*E21B 10/10* (2006.01)
(Continued)

(52) U.S. Cl.
CPC ..... *E21B 10/14* (2013.01); *E21B 10/10* (2013.01); *E21B 10/12* (2013.01); *E21B 10/20* (2013.01); *E21B 10/22* (2013.01)

(58) Field of Classification Search
CPC ..... E21B 10/14; E21B 10/10; E21B 10/12; E21B 10/20; E21B 10/22; E21B 10/06; E21B 10/26; E21B 10/46
See application file for complete search history.

(56) References Cited

U.S. PATENT DOCUMENTS 2,117,481 A 5/1938 Howard
2,320,136 A 5/1943 Kammerer
(Continued)

FOREIGN PATENT DOCUMENTS

CN 1727634 A 2/2006
CN 206190217 U 2/2006
(Continued)

OTHER PUBLICATIONS

International Search Report and Written Opinion issued in International Patent application PCT/US2020/033989 on Sep. 1, 2020, 14 pages.

(Continued)

*Primary Examiner* — Caroline N Butcher
(74) *Attorney, Agent, or Firm* — Bryan K. Adams

(57) ABSTRACT

A hybrid bit includes a fixed cutting structure and a rolling cutting structure. The fixed cutting structure includes a plurality of fixed cutting elements. The rolling cutting structure is coupled to the fixed cutting structure and includes a journal bore extending through the rolling cutting structure from a leading face to a trailing face, and a radially outer surface. The rolling cutting structure also includes a plurality of cutting elements extending from the radially outer surface of the rolling cutting structure.

20 Claims, 17 Drawing Sheets

(51) Int. Cl.

| | |
|---|---|
| ***E21B 10/12*** | (2006.01) |
| ***E21B 10/20*** | (2006.01) |
| ***E21B 10/22*** | (2006.01) |

(56) References Cited

U.S. PATENT DOCUMENTS

| | | | | |
|---|---|---|---|---|
| 2,520,517 | A | 8/1950 | Taylor | |
| 2,725,215 | A | 11/1955 | Macneir | |
| 2,877,988 | A | 3/1959 | Cameron | |
| 3,055,443 | A | 9/1962 | Edwards | |
| 4,006,788 | A | 2/1977 | Garner | |
| 4,203,496 | A | 5/1980 | Baker, III et al. | |
| 4,285,409 | A | 8/1981 | Allen | |
| 4,343,371 | A | 8/1982 | Baker, III et al. | |
| 4,359,112 | A | 11/1982 | Garner et al. | |
| 4,444,281 | A | 4/1984 | Schumacher, Jr. et al. | |
| 4,448,269 | A | 5/1984 | Ishikawa et al. | |
| 4,892,159 | A | 1/1990 | Holster | |
| 5,145,017 | A | 9/1992 | Holster et al. | |
| 5,176,212 | A | 1/1993 | Tandberg | |
| 5,695,019 | A | 12/1997 | Shamburger, Jr. | |
| 5,862,871 | A | 1/1999 | Curlett | |
| 6,345,673 | B1 | 2/2002 | Siracki | |
| 6,439,326 | B1 | 8/2002 | Huang et al. | |
| 6,561,291 | B2 | 5/2003 | Xiang | |
| 6,688,410 | B1 | 2/2004 | Singh et al. | |
| 6,786,288 | B2 | 9/2004 | Singh | |
| 6,863,138 | B2 | 3/2005 | Siracki | |
| 7,059,430 | B2 | 6/2006 | Singh et al. | |
| 7,341,119 | B2 | 3/2008 | Singh et al. | |
| 7,819,208 | B2 | 10/2010 | Pessier et al. | |
| 7,841,426 | B2 | 11/2010 | Zahradnik et al. | |
| 7,845,435 | B2 | 12/2010 | Zahradnik et al. | |
| 8,047,307 | B2 | 11/2011 | Pessier et al. | |
| 8,082,134 | B2 | 12/2011 | Huang | |
| 8,141,664 | B2 | 3/2012 | Zahradnik et al. | |
| 8,157,026 | B2 | 4/2012 | Kulkarni | |
| 8,336,646 | B2 | 12/2012 | Kulkarni | |
| 8,356,398 | B2 | 1/2013 | McCormick et al. | |
| 8,459,378 | B2 | 6/2013 | Zahradnik et al. | |
| 8,550,190 | B2 | 10/2013 | Hall et al. | |
| 8,672,060 | B2 | 3/2014 | Centala et al. | |
| 8,678,111 | B2 | 3/2014 | Zahradnik et al. | |
| 8,881,848 | B2 | 11/2014 | Knull et al. | |
| 8,950,514 | B2 | 2/2015 | Buske et al. | |
| 8,955,413 | B2 | 2/2015 | Bijai et al. | |
| 8,985,243 | B2 | 3/2015 | Yang et al. | |
| 9,004,198 | B2 | 4/2015 | Kulkarni | |
| 9,033,069 | B2 * | 5/2015 | Zhang | E21B 10/08 175/341 |
| 9,103,168 | B2 | 8/2015 | Yang et al. | |
| 9,212,523 | B2 | 12/2015 | Yong et al. | |
| 9,353,575 | B2 | 5/2016 | Zahradnik et al. | |
| 9,428,965 | B2 | 8/2016 | Jones | |
| 9,556,681 | B2 | 1/2017 | Kulkarni | |
| 9,574,405 | B2 | 2/2017 | Cariveau et al. | |
| 9,657,527 | B2 | 5/2017 | Buske et al. | |
| 9,670,736 | B2 | 6/2017 | Zahradnik et al. | |
| 9,850,716 | B2 | 12/2017 | Lin et al. | |
| 9,976,353 | B2 | 5/2018 | Hinz et al. | |
| 10,066,439 | B2 | 9/2018 | Hinz et al. | |
| 10,072,462 | B2 | 9/2018 | Zahradnik et al. | |
| 10,100,581 | B1 | 10/2018 | Timte | |
| 10,107,040 | B2 | 10/2018 | Evans et al. | |
| 10,156,099 | B2 | 12/2018 | Do | |
| 10,190,366 | B2 | 1/2019 | Zahradnik et al. | |
| 10,352,101 | B2 | 7/2019 | Yang | |
| 10,704,330 | B2 | 7/2020 | Clausen | |
| 10,731,420 | B2 | 8/2020 | Dahlgren et al. | |
| 10,988,988 | B2 | 4/2021 | Clausen | |
| 2003/0136588 | A1 | 7/2003 | Truax et al. | |
| 2007/0131457 | A1 | 6/2007 | McDonough et al. | |
| 2009/0159338 | A1 | 6/2009 | Buske | |
| 2010/0025119 | A1 | 2/2010 | Stauffer | |
| 2010/0155146 | A1 | 6/2010 | Nguyen | |
| 2010/0288561 | A1 | 11/2010 | Zahradnik et al. | |
| 2012/0130685 | A1 | 5/2012 | Huang | |
| 2012/0205160 | A1 | 8/2012 | Ricks et al. | |
| 2013/0098688 | A1 | 4/2013 | Yong et al. | |
| 2014/0151131 | A1 | 6/2014 | Zahradnik et al. | |
| 2014/0196956 | A1 | 7/2014 | Centala et al. | |
| 2014/0202771 | A1 | 7/2014 | Zahradnik et al. | |
| 2014/0202774 | A1 | 7/2014 | Bowden et al. | |
| 2014/0353046 | A1 | 12/2014 | Zhang et al. | |
| 2015/0075873 | A1 | 3/2015 | Jones | |
| 2015/0090501 | A1 | 4/2015 | King | |
| 2015/0152687 | A1 | 6/2015 | Nguyen et al. | |
| 2015/0197992 | A1 | 7/2015 | Ricks et al. | |
| 2015/0211303 | A1 | 7/2015 | Buske et al. | |
| 2015/0285003 | A1 | 10/2015 | Kulkarni | |
| 2015/0337603 | A1 | 11/2015 | Schroder | |
| 2015/0368977 | A1 * | 12/2015 | Yang | E21B 10/43 175/336 |
| 2016/0108680 | A1 | 4/2016 | Rothe | |
| 2016/0230468 | A1 | 8/2016 | Ricks et al. | |
| 2016/0237752 | A1 | 8/2016 | Jones | |
| 2016/0251902 | A1 | 9/2016 | Zahradnik et al. | |
| 2016/0319602 | A1 | 11/2016 | Zhang | |
| 2016/0348440 | A1 * | 12/2016 | Gan | E21B 10/08 |
| 2017/0058609 | A1 | 3/2017 | Chen et al. | |
| 2017/0167201 | A1 | 6/2017 | Clausen | |
| 2018/0087323 | A1 * | 3/2018 | Dahlgren | E21B 10/20 |
| 2018/0298696 | A1 | 10/2018 | Barry | |

FOREIGN PATENT DOCUMENTS

| | | | |
|---|---|---|---|
| CN | 201751525 | U | 2/2011 |
| CN | 102392605 | A | 3/2012 |
| CN | 202220555 | U | 5/2012 |
| CN | 101886522 | B | 7/2012 |
| CN | 101892810 | B | 7/2012 |
| CN | 203201474 | U | 9/2013 |
| CN | 203201475 | U | 9/2013 |
| CN | 103742077 | A | 4/2014 |
| CN | 102561953 | B | 11/2014 |
| CN | 102392603 | B | 5/2015 |
| CN | 102400646 | B | 5/2015 |
| CN | 102434105 | B | 6/2015 |
| CN | 103015899 | B | 7/2015 |
| CN | 103089154 | B | 7/2015 |
| CN | 103089156 | B | 7/2015 |
| CN | 103147691 | B | 7/2015 |
| CN | 103758458 | B | 12/2015 |
| CN | 103939022 | B | 12/2015 |
| CN | 105113995 | A | 12/2015 |
| CN | 105649536 | A | 6/2016 |
| CN | 103758457 | B | 11/2016 |
| CN | 106320989 | A | 1/2017 |
| CN | 205876191 | U | 1/2017 |
| CN | 205876194 | U | 1/2017 |
| CN | 206129165 | U | 4/2017 |
| CN | 106639886 | A | 5/2017 |
| CN | 206174872 | U | 5/2017 |
| CN | 206190213 | U | 5/2017 |
| CN | 106869802 | A | 6/2017 |
| CN | 206220857 | U | 6/2017 |
| CN | 107060653 | A | 8/2017 |
| CN | 206655657 | U | 11/2017 |
| CN | 105804663 | B | 1/2018 |
| CN | 207048679 | U | 2/2018 |
| CN | 207048684 | U | 2/2018 |
| CN | 106382098 | B | 5/2018 |
| CN | 207420457 | U | 5/2018 |
| CN | 207553972 | U | 6/2018 |
| CN | 108798514 | A | 11/2018 |
| CN | 108868625 | A | 11/2018 |
| CN | 106014266 | B | 5/2019 |
| CN | 106437525 | B | 11/2019 |

(56) References Cited

FOREIGN PATENT DOCUMENTS

| | | | | |
|---|---|---|---|---|
| CN | 108868622 | B | 6/2020 | |
| WO | WO-2019035838 | A1 * | 2/2019 | ..... E21B 10/10 |

OTHER PUBLICATIONS

Dolezal et al., "Expansion of Field Testing and Application of New Hybrid Drill Bit." SPE 146737. Denver, Colorado, Nov. 2011, 12 pages.

Pessier et al., "Hybrid Bits Offer Distinct Advantages in Selected Roller-Cone and PDC-Bit Applications." SPE 128741 Drilling & Completion. Mar. 2011, 8 pages.

International Preliminary Report on Patentability issued in International Patent application PCT/US2020/033989 dated Dec. 2, 2021, 11 pages.

* cited by examiner

HYBRID BIT

CROSS-REFERENCE TO RELATED APPLICATIONS

This application is the U.S. national phase of International Patent Application No. PCT/US2020/033989, filed May 21, 2020, and entitled "Hybrid Bit," which claims the benefit of, and priority to, U.S. Patent Application No. 62/850,619 filed on May 21, 2019, which is incorporated herein by this reference in its entirety.

BACKGROUND OF THE DISCLOSURE

Downhole bits include two categories: fixed bits, or "drag" bits, and rotary bits. Fixed bits include fixed cutting structures that do not move relative to the bit as the bit rotates. Rotary bits include one or more rotary cutting structures that rotate relative to the bit as the bit rotates. Hybrid bits include some aspect of both fixed bits and rotary bits.

SUMMARY

In some aspects, a bit includes a wheel-shaped rolling cutting structure that includes a plurality of cutting elements located on a radially outer surface of the bit.

In other aspects, a hybrid bit includes one or more fixed cutting structures and one or more rolling cutting structures, the rolling cutting structures including a plurality of conical cutting elements. The rolling cutting structures may be conical or non-conical.

In yet other embodiments, a kit for drilling includes a conical or non-conical rolling cutting structure having cutting elements located on a radially outward surface of the rolling cutting structure. The kit may include a plurality of sleeves, each sleeve being configured to adjust a height of the rolling cutting structure.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of a rolling cutting structure, according to at least one embodiment of the present disclosure;

FIG. 2-2 is a cross-sectional view of the rolling cutting structure of FIG. 2-1, according to at least one embodiment of the present disclosure;

FIG. 3-1 is a perspective view of a bit, according to at least one embodiment of the present disclosure;

FIG. 3-2 is a bottom view of the bit of FIG. 3-1, according to at least one embodiment of the present disclosure;

FIG. 3-3 is a cross-sectional view of the bit of FIG. 3-1, according to at least one embodiment of the present disclosure;

FIG. 3-4 is a cutting element profile of the bit of FIG. 3-1, according to at least one embodiment of the present disclosure;

FIG. 3-5 is another cross-sectional view of the bit of FIG. 3-1, according to at least one embodiment of the present disclosure;

FIG. 4 is a perspective view of a sleeve, according to at least one embodiment of the present disclosure;

FIG. 5-1 is a perspective view of a bit, according to at least one embodiment of the present disclosure;

FIG. 5-2 is a bottom view of the bit of FIG. 5-1, according to at least one embodiment of the present disclosure;

FIG. 5-3 is a side view of the bit of FIG. 5-1, according to at least one embodiment of the present disclosure;

FIG. 7-1 is a perspective view of a bit, according to at least one embodiment of the present disclosure;

FIG. 7-2 is a bottom view of the bit of FIG. 7-1, according to at least one embodiment of the present disclosure;

FIG. 7-3 is a cross-sectional view of the bit of FIG. 7-1, according to at least one embodiment of the present disclosure;

FIG. 7-4 is another cross-sectional view of the bit of FIG. 7-1, according to at least one embodiment of the present disclosure;

FIG. 7-5 is a cutting profile of the bit of FIG. 7-1, according to at least one embodiment of the present disclosure.

DETAILED DESCRIPTION

Figure 1:
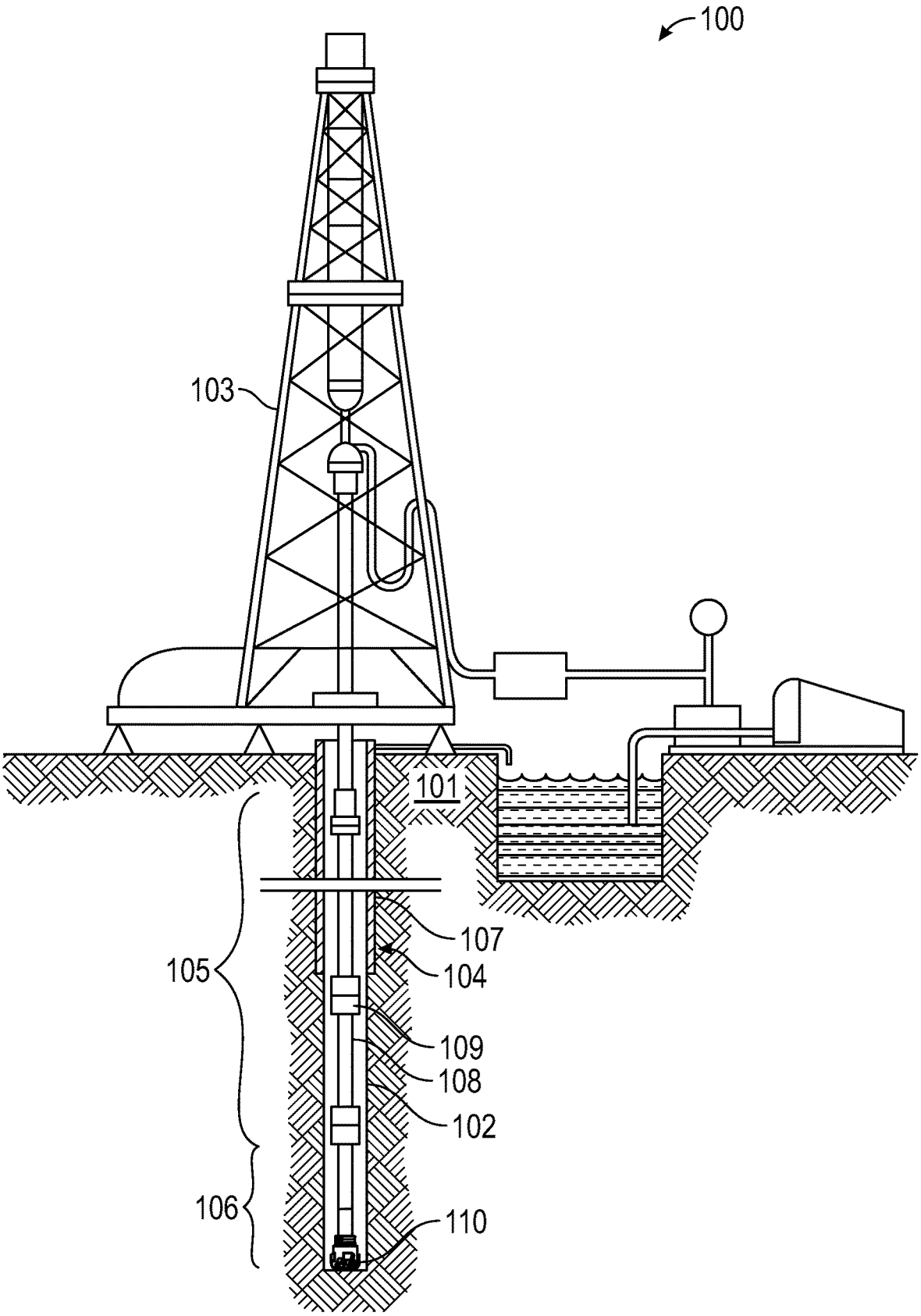
FIG. 1 is a representation of a drilling system, according to at least one embodiment of the present disclosure.

This disclosure generally relates to devices, systems, and methods for drill bits including cutting elements. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, cleaning the bit 110 and cutting structures thereon of any cuttings, swarf, or other material that may have accumulated on the bit 110 and/or the cutting structures, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, steering tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
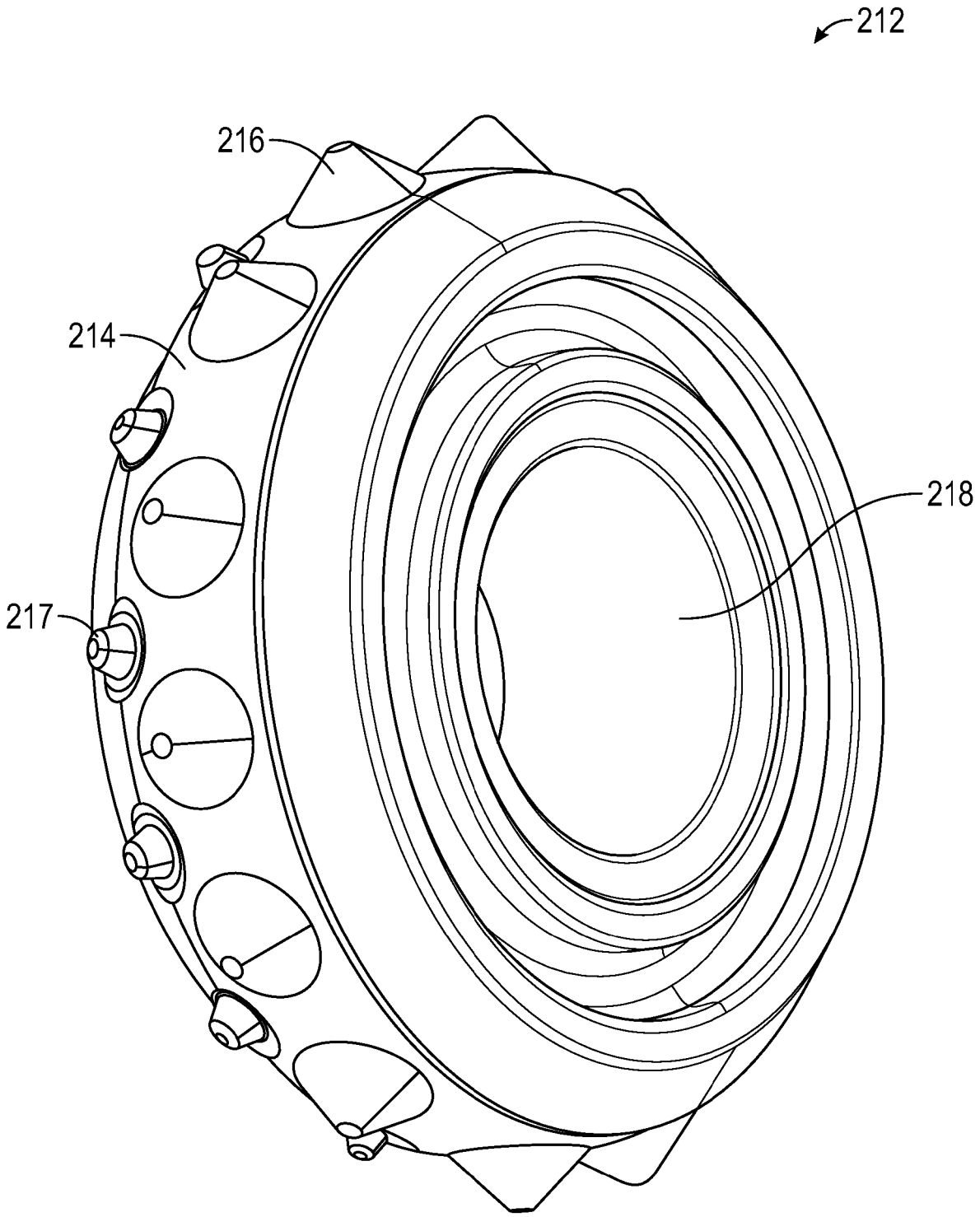
Figure 2:
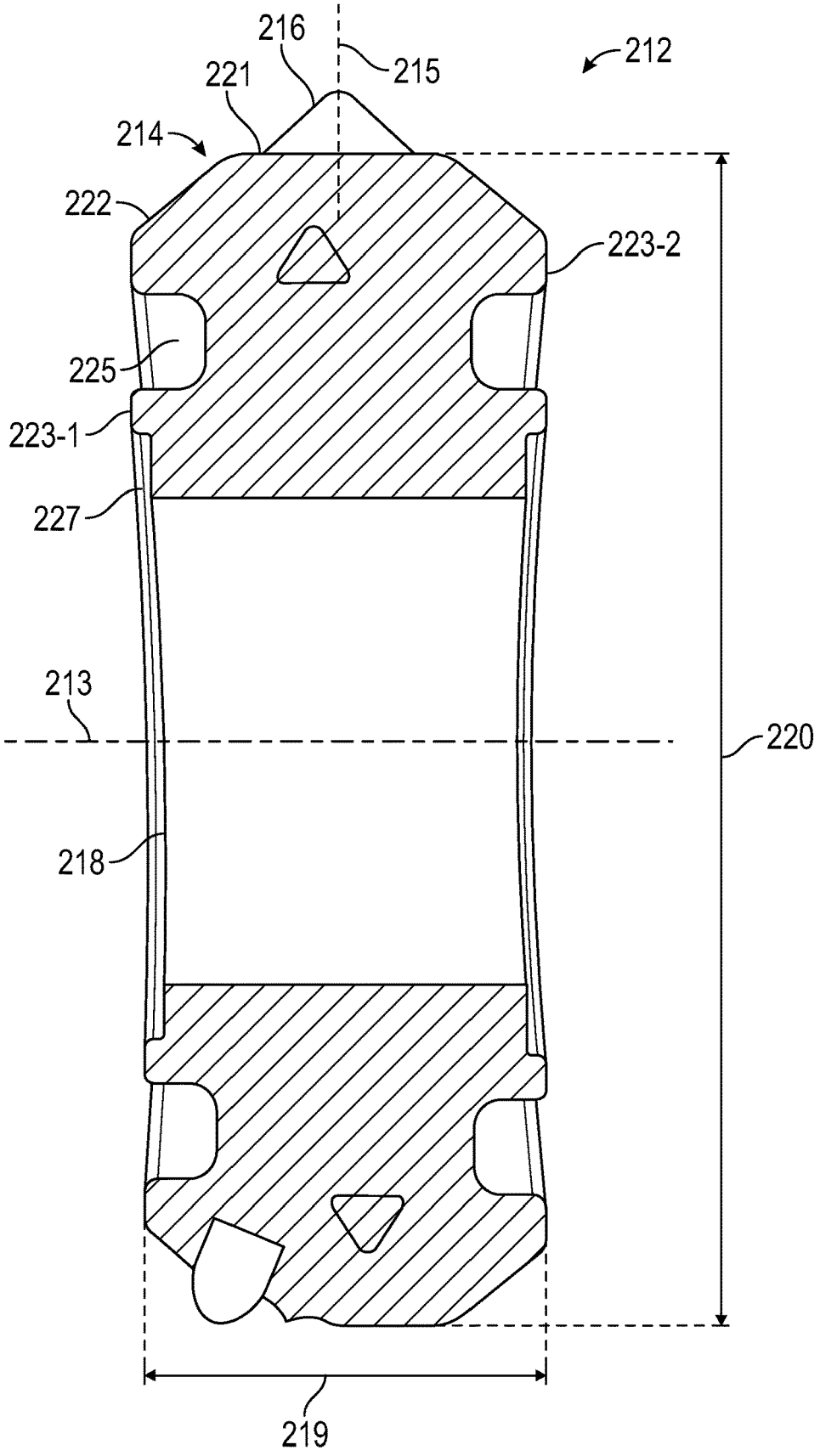

FIG. 2-1 is a perspective view of a rolling cutting structure 212, according to at least one embodiment of the present disclosure. In some embodiments, the rolling cutting structure 212 may be wheel-shaped, or generally wheel-shaped. The rolling cutting structure 212 has an outer surface 214. A plurality of cutting elements 216 may be attached to the outer surface 214 or inserted into a pocket in the outer surface 214. For example, the plurality of cutting elements 216 may be attached to the rolling cutting structure 212 using any method, including braze, weld, mechanical fastener, press-fit, interference fit, or any other type of connection.

In some embodiments, a hard material forms the cutting element 216 or a substrate thereof. Substrates according to embodiments of the present disclosure may be formed of cemented carbides, such as tungsten carbide, titanium carbide, chromium carbide, niobium carbide, tantalum carbide, vanadium carbide, or combinations thereof cemented with iron, nickel, cobalt, or alloys thereof. For example, a substrate may be formed of cobalt-cemented tungsten carbide. Ultrahard layers according to embodiments of the present disclosure may be formed of, for example, polycrystalline diamond, such as formed of diamond crystals bonded together by a metal catalyst such as cobalt or other Group VIII metals under sufficiently high pressure and high temperatures (sintering under HPHT conditions), thermally stable polycrystalline diamond (polycrystalline diamond having at least some or substantially all of the catalyst material removed), or cubic boron nitride. Further, it is also within the scope of the present disclosure that the ultrahard layer may be formed from one or more layers, Which may have a gradient or stepped transition of diamond content therein. In such embodiments, one or more transition layers (as well as the other layer) may include metal carbide particles therein. Further, when such transition layers are used, the combined transition layers and outer layer may collectively be referred to as the ultrahard layer, as that term has been used in the present application. That is, the interface surface on which the ultrahard layer (or plurality of layers including an ultrahard material) may be formed is that of the cemented carbide substrate.

In some embodiments, the cutting elements 216 may be conical or frustoconical in shape. In other embodiments, the cutting elements 216 may have an outer surface that is convex or concave. In still other embodiments, the cutting elements 216 may have an outer surface that has multiple taper angles, multiple radii of curvature, different concavities, at least one straight and at least one curved section, any other cutting element geometry, or combinations thereof. The cutting elements 216 may have non-planar surfaces that are directed radially outward from the outer surface 214. In yet other embodiments, the cutting elements 216 may be apexed, pointed, ridged, or have any other shape. In further embodiments, the cutting elements may be a cross-sectional shape including one or more of round (e.g., circular, ellipsoidal), polygonal (e.g., hexagonal, pentagonal, square, or polygon of any side), or non-polygonal (e.g., straight and curved edges). In some embodiments, the cutting elements 216 may be radially symmetrical. The cutting elements 216 may include one, two, three, four, five, six, or more planes of symmetry. In other embodiments, the cutting elements 216 may be asymmetric, or include no plane of symmetry. In the same or other embodiments, the cutting elements may have a non-symmetric three-dimensional shape, including points that are located away from the longitudinal axis of the cutting elements. The cutting elements 216 may include diamond, such as polycrystalline diamond, or may be any suitable cutting element.

As noted above, the plurality of cutting elements 216 may be attached to the outer surface 214 or inserted into a pocket in the outer surface 214. In some embodiments, the cutting elements 216 only extend from the outer surface 214 of the rolling cutting structure 212 in the radial direction and do not extend from a leading face or trailing face of the rolling cutting structure 212. In some embodiments, each cutting element 216 has a respective cutting element axis 215 that generally extends through a center of the substrate of the cutting element 216 and a center of a cutting face of the cutting element. The cutting element axes 215 may extend radially from the outer surface 214 of the rolling cutting structure 212. In some embodiments, the cutting element axes 215 of one or more rows may be perpendicular to an axis 213 (e.g., journal axis) of the rolling cutting structure 212. Due to the shape and profile of the outer surface 214, the angle between the cutting element axis and the outer surface 214 where the cutting element is attached may be different than the angle between the cutting element axis and the axis 213 of the rolling cutting structure 212.

Although wheels are generally described through the specification with regard to the rotating cutting structure 212, in some embodiments, the wheels are cone or truncated cone rolling cutting structures.

In some embodiments, the rolling cutting structure 212 may include one or more rows of cutting elements 216. A first row (e.g., leading row) of cutting elements 216 may include one or more primary cutting elements 216, and a second row (e.g., trailing row) of cutting elements may include one or more secondary cutting elements 217 attached to the outer surface 214 of the rolling cutting structure 212. The primary and secondary cutting elements 216, 217 may be diamond inserts, or may be any cutting element used in downhole drilling. In some embodiments, the rolling cutting structure 212 may only include the cutting elements 216, without the secondary cutting elements 217. In some embodiments, at least 50 percent of the cutting elements have an ultrahard coating. In some embodiments, at least 90 percent of the cutting elements have an ultrahard coating. In some embodiments, all of the cutting elements have an ultrahard coating.

In some embodiments, the rolling cutting structure 212 may include three or more rows of cutting elements. The shapes of cutting elements may vary between rows or among rows. For example, a primary or leading row may have conical cutting elements, and a secondary or trailing row may have domed cutting elements. Furthermore, the nominal size (e.g., diameter, characteristic width, extension from the outer surface 214) of the cutting elements may vary between rows, or among cutting elements within a row. For example, the cutting elements of a leading row may have a smaller diameter than the cutting elements of a trailing row, and the cutting elements of a tertiary row may be approximately the same size or smaller than the cutting elements of the leading row. Furthermore, the extension of the cutting elements from the outer surface 214 may vary between the rows. The extension of the cutting elements 216 in the leading row may be greater than the extension of secondary cutting elements 217 in one or more trailing rows. Due to the journal angle of the rolling cutting structure 212 of some embodiments, the secondary cutting elements 217 of one or more secondary rows may extend further relative to a face of the bit than the primary cutting elements 216 of the leading row despite shorter extensions of the secondary cutting elements 217 from the outer surface 214 than the primary cutting elements 216. That is, in some embodiments the cutting profile of the secondary cutting elements 217 may extend further from the leading face of the bit than the cutting profile of the primary cutting elements 216. The cutting elements of the primary row and any tertiary rows may be configured to engage the formation and reduce wear on the trailing edge of the blade with the rolling cutting structure 212.

The rolling cutting structure 212 may include a journal bore 218. The journal bore 218 may extend the width 219 of the rolling cutting structure 212. In some embodiments, a journal and journal axle may be configured to be inserted into the journal bore 218, and the rolling cutting structure 212 may rotate about the journal axle.

FIG. 2-2 is a cross-sectional view parallel to a longitudinal or rotational axis of the rolling cutting structure 212 shown in FIG. 2-1, according to at least one embodiment of the present disclosure. The rolling cutting structure 212 may be cylindrical, or approximately cylindrical. The rolling cutting structure 212 has a wheel width 219. The wheel width 219 may be less than a wheel diameter 220. For example, the wheel width 219 may be less than 50% of the wheel diameter 220. In other examples, the wheel width 219 may be less than 40% of the wheel diameter 220. In still other examples, the wheel width 219 may be less than 80%, 75%, 70%, 65%, 60%, 55%, 50%, 45%, 40%, 35%, 30%, 25%, 20% 17.5%, 15%, 12.5%, 10%, 8%, 6%, or 5% of the wheel diameter 220. Thus, because the wheel width 219 is less than, and even much less than, than the wheel diameter 220, the rolling cutting structure 212 may be wheel-shaped. In other words, a wheel-shaped rolling cutting structure 212 has a wheel width 219 that is less than or significantly less than the wheel diameter 220. In at least one embodiment, it may be critical that the wheel width 219 is less than 50% of the wheel diameter 220. In other embodiments, it may be critical that the wheel width 219 is less than 35% of the wheel diameter 220. These percentages may strike a balance between being supported in a blade (not shown) of a bit and strength of the rolling cutting structure 212.

In some embodiments, a wheel-shaped rolling cutting structure 212 is non-conical (e.g., partially conical, frusto-conical, truncated conical, domed, spherical, hemispherical, partially spherical, ellipsoidal, egg-shaped, paraboloidal, and so forth). In other embodiments, the wheel-shaped rolling cutting structure 212 is, e.g., partially conical, frustoconical, truncated conical, or the like.

A wheel-shaped rolling cutting structure 212 may include a bevel, such as beveled portion 222. The bevel 222 may be a different size and/or geometry on each side of the wheel-shaped rolling cutting structure, may be identical on each side of the wheel-shaped rolling cutting structure as shown in FIG. 2-2, or may be located only on one side of the wheel-shaped rolling cutting structure. When a bevel 222 is located on one side only or is different on both sides of the wheel-shaped rolling cutting structure, it may appear to be partially conical, and this geometry is considered to be within the scope of the present disclosure. In some embodiments, the wheel diameter 220 may be the same or approximately the same (i.e., within 5%) at a first side 223-1 as a second side 223-2 of the rolling cutting structure. In some embodiments, the rolling cutting structure 212 may be symmetrical about a plane transverse or perpendicular to the wheel width 219.

In some embodiments, the wheel width 219 may be in a range having an upper value, a lower value, or upper and lower values including any of 0.3 in. (7.62 mm), 0.4 in. (10.16 mm), 0.5 in. (12.70 mm), 0.6 in. (15.24 mm), 0.7 in. (17.78 mm), 0.8 in. (20.32 mm), 0.9 in. (22.86 mm), 1.0 in. (25.40 mm), 1.25 in. (31.75 mm), 1.5 in. (38.1 mm), 1.75 in. (44.45 mm), 2.0 in. (50.8 mm), 2.25 in. (57.15 mm), 2.5 in. (63.50 mm), 2.75 in. (69.85 mm), 3.0 in. (76.2 mm), 3.5 in. (88.90 mm), 4.0 in. (101.6 mm), or any value therebetween. For example, the wheel width 219 may be greater than 0.3 in. (7.62 mm). In another example, the wheel width 219 may be less than 4.0 in. (101.6 mm). In yet other examples, the wheel width 219 may be any value in a range between 0.3 in. (7.62 mm) and 4.0 in. (101.6 mm).

In some embodiments, the wheel diameter 220 may be in a range having an upper value, a lower value, or upper and lower values including any of 2.0 in. (5.08 cm), 2.5 in. (6.35 cm), 3.0 in. (7.62 cm), 3.5 in. (8.89 cm), 4.0 in. (10.16 cm), 4.5 in. (11.43 cm), 5.0 in. (12.70 cm), 5.5 in. (13.97 cm), 6.0 in. (15.24 cm), 7.0 in. (17.78 cm), 8.0 in. (20.32 cm), 9.0 in. (22.86 cm), 10.0 in. (25.40 cm), 12 in. (30.48 cm), 14 in. (35.56 cm), 16 in. (40.64 cm), 18 in. (45.72 cm), 20 in. (50.80 cm), 21 in. (53.34 cm), 22 in. (55.88 cm), 24 in. (60.96 cm) 25 in. (63.50 cm), or any value therebetween. For example, the wheel diameter 220 may be greater than 1.0 in. (2.54 cm). In another example, the wheel diameter 220 may be less than 10.0 in. (25.40 cm). In yet other examples, the wheel diameter 220 may be any value in a range between 1.0 in. (2.54 cm) and 10.0 in. (25.40 cm).

In some embodiments, the wheel diameter 220 may be a diameter percentage of a bit diameter. In some embodiments, the diameter percentage may be in a range having an upper value, a lower value, or upper and lower values including any of 10%, 15%, 20%, 25%, 30%, 35%, 40%, 45%, 50%, 55%, 60%, 65%, 70%, 75%, or any value therebetween. For example, the diameter percentage may be greater than 10%. In another example, the diameter percentage may be less than 75%. In yet other examples, the diameter percentage may be any value in a range between 10% and 75%. In some embodiments, it may be critical that the diameter percentage is at least 50% to provide for a greater percentage of cutting of the formation by the rolling cutting structure 212.

The outer surface 214 may be located on a radially outer surface of the rolling cutting structure 212. In some embodiments, the outer surface 214 may include an upper portion 221. In at least one embodiment, the upper portion 221 may be flat. In some embodiments, the upper portion 221 may be curved (e.g., elliptical, semicircular) or frustoconical. In the embodiment shown, longitudinally across the upper portion 221, the wheel diameter 220 may remain constant, may not change, or may change only slightly. The cutting elements 216 may be attached to the outer surface 214 at the upper portion 221. In some embodiments, the rolling cutting structure 212 may include a beveled portion 222 along the outer surface 214. For example, across the beveled portion 222, the wheel diameter 220 may decrease toward a side edge 223 of the rolling cutting structure 212. The beveled portion 222 may help to prevent the rolling cutting structure 212 from contacting the wellbore bottom as the rolling cutting structure engages the formation. Furthermore the beveled portion 222 may help to reduce stress, and therefore cracking, spalling, and breaking, of the rolling cutting structure 212 at the intersection between the outer surface 214 and the side edge 223. In some embodiments, the outer surface 214 may be beveled along both edges of the rolling cutting structure 212. In other embodiments, the outer surface 214 may be beveled along a single edge of the rolling cutting structure. One or more cutting elements 216 or rows of cutting elements may be disposed on the beveled portions of the outer surface 214. For example, leading and/or trailing rows of cutting elements may be disposed on the beveled portions of the outer surface 214. The one or more cutting elements 216 may not extend axially beyond a leading or trailing face of the rolling cutting structure 212.

In some embodiments, the rolling cutting structure 212 may include an axial race 225. The axial race 225 may be configured to accept an axial bearing or an axial seal. The rolling cutting structure 212 may include a thrust washer cavity 227. A thrust washer (not shown) may be inserted between the thrust washer cavity 227 and a blade (not shown) to provide bearing support between the rolling cutting structure 212 and the blade. In at least one embodiment, a thrust washer cavity 227 may be located on either side of the rolling cutting structure 212.

Figures 1, 3:
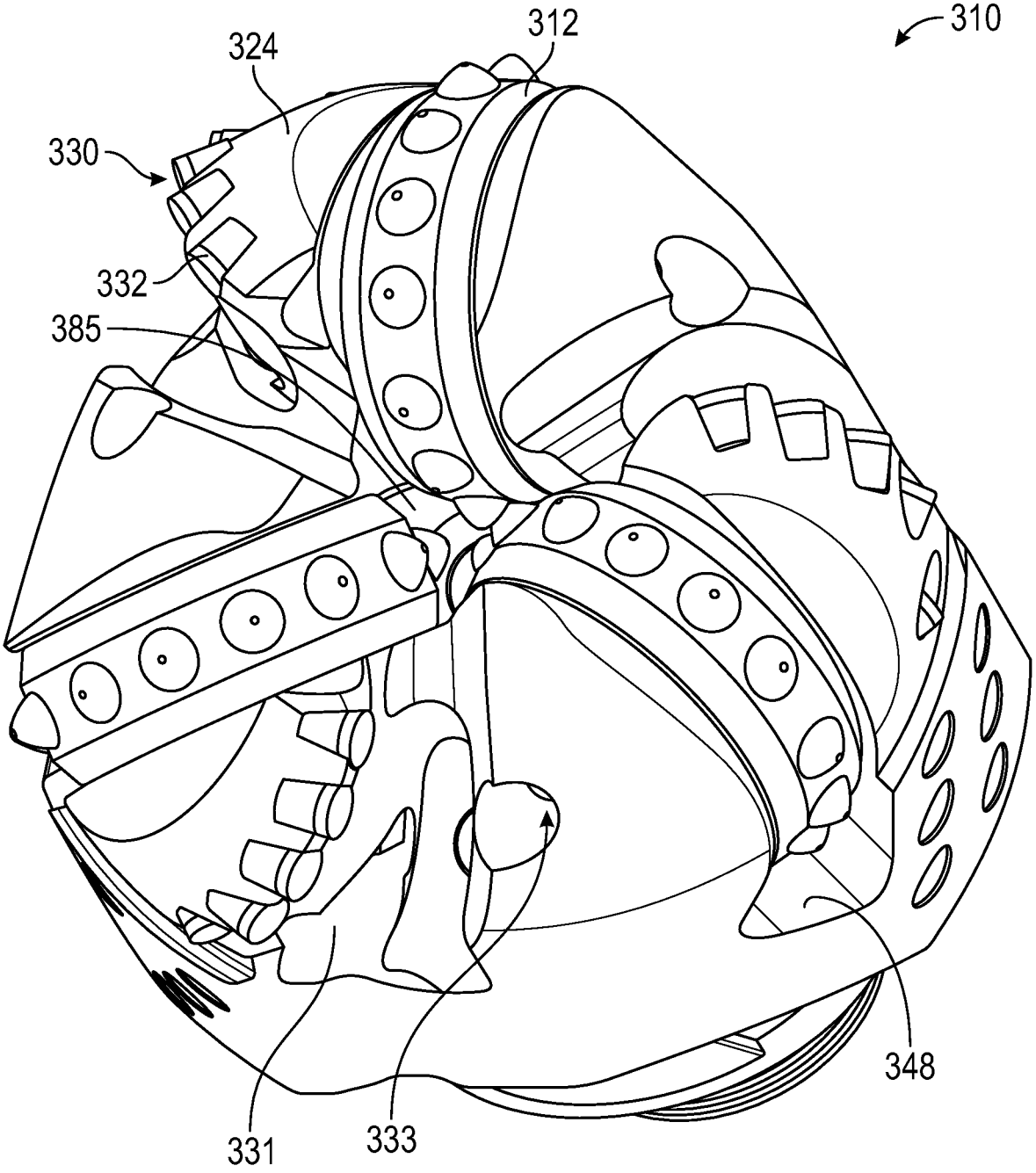
Figures 2, 3:
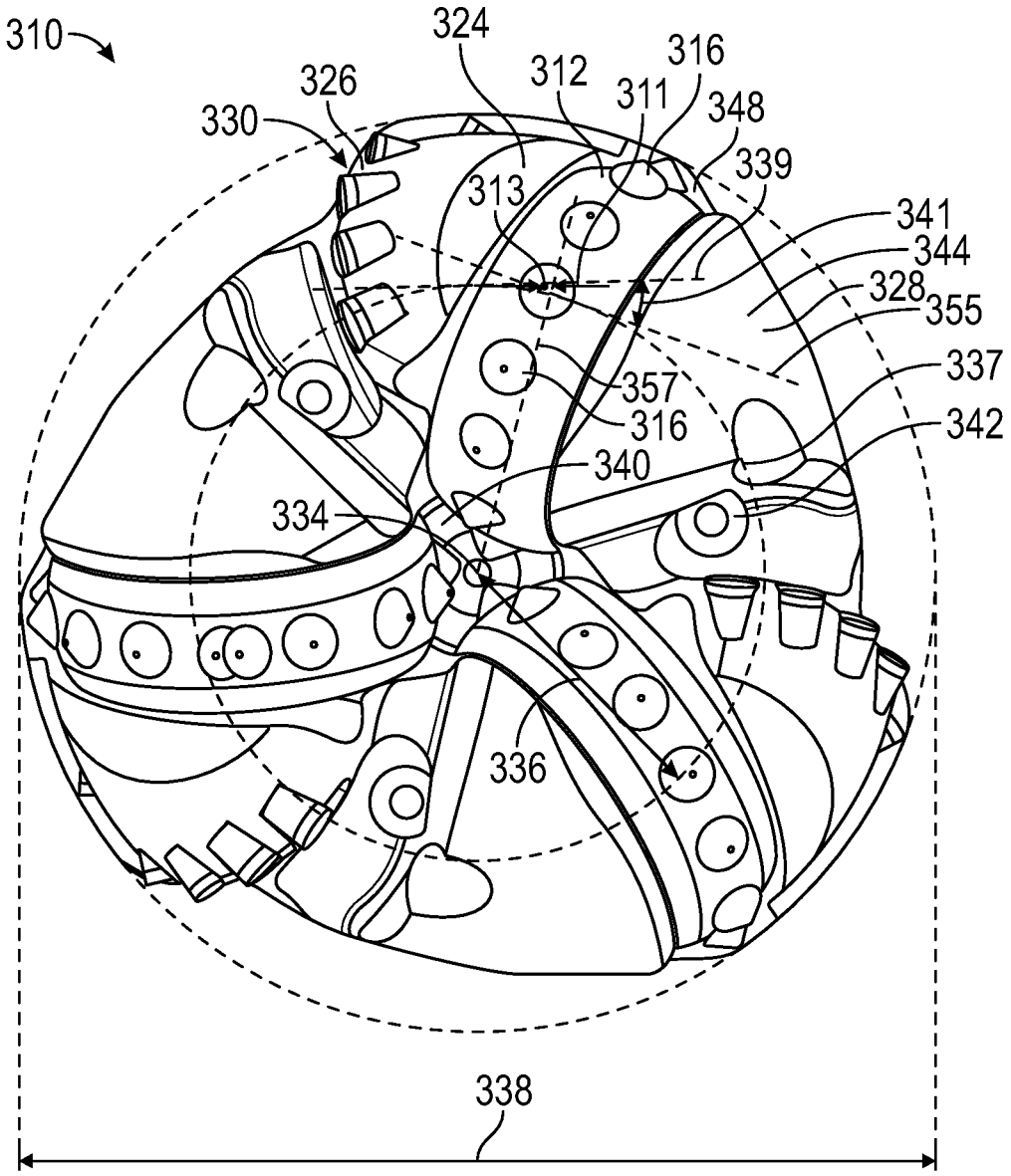
Figure 3:
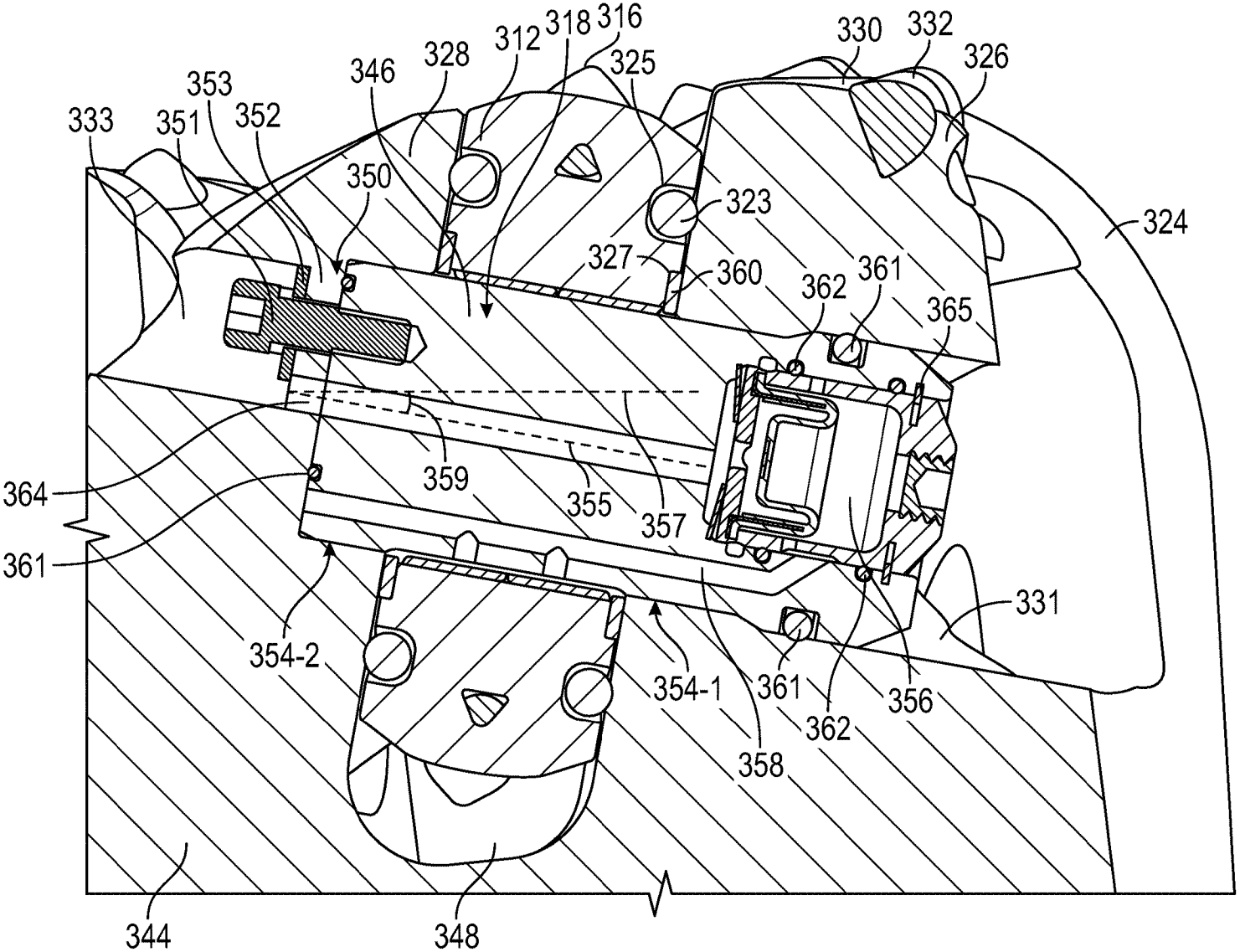

FIG. 3-1 is a representation of a bit 310, according to at least one embodiment of the present disclosure. The bit 310 may include one or more blades 324. The bit 310 may be formed of a matrix material, an alloy material (e.g., steel), or any combination thereof. In some embodiments, one or more portions of the bit 310 are formed by an additive manufacturing process. The blade 324 may include a fixed cutting structure and a rolling cutting structure 312. The rolling cutting structure 312 may include at least some of the same features and characteristics as the rolling cutting structure 212 described in relation to FIG. 2-1 and FIG. 2-2.

In some embodiments, the fixed cutting structure 330 may include one or more fixed cutting elements 332. In some embodiments, the fixed cutting elements 332 may be standard PDC cutting elements. In other embodiments, the fixed cutting elements 332 may be any other type of cutting element used in downhole drilling tools. In some embodiments, the fixed cutting elements 332 may be brazed or welded to the blade 324. In other embodiments, the fixed cutting elements 332 may be attached to the blade 324 with a rotating connection, such that each fixed cutting element 332 independently rotates about its own longitudinal axis. Therefore, the fixed cutting structure 330 means that the location of the fixed cutting elements 332 do not change with respect to the blade 324.

A journal axle (not shown) may be inserted into a journal cavity 331 in the leading surface of the blade 324. The journal axle may be secured to the blade 324 using fastener inserted through a cavity 333 at the trailing surface of the blade 324. For example, a threaded fastener may be inserted into a bolt cavity 333. The journal axle may secure the rolling cutting structure 312 to the blade 324. The rolling cutting structure 312 may then rotate about the journal axle. The rolling cutting structure 312 may be secured within a slot 348 of the blade 324. In some embodiments, as shown in FIG. 3-1, one or more slots 348 may be open to a central cavity 385 of the bit 310. The central cavity 385 may be open to the bit axis 334 and one or more junk slots of the bit 310 as shown in FIG. 3-1, or separated from one or more junk slots as shown in FIG. 5-1. The rolling cutting structures 312 and the fixed cutting structures 330 may be disposed between the central cavity 385 and the gauge of section of the bit 310.

FIG. 3-2 is a representation of the bit 310 of FIG. 1, according to at least one embodiment of the present disclosure. The blade 324 has a leading edge 326 and a trailing edge 328. In some embodiments, the fixed cutting structure 330 may be located at the leading edge 326 of the blade 324. The rolling cutting structure 312 may be located at or near a trailing edge 328 of the blade 324. Thus, the fixed cutting structure 330 and the rolling cutting structure 312 may be located on the same blade (e.g., blade 324). The rolling cutting structure 312 may be located within the slot 348 of the blade 324.

In the embodiment shown in FIG. 3-2, the bit 310 includes three blades 324. The three blades 324 may be evenly spaced around a circumference of the bit 310. In other words, the blades 324 may be spaced 120° apart. In other embodiments, the bit 310 may include less than or more than three blades. For example, the bit 310 may include two blades, spaced 180° apart. In other examples, the bit 310 may include four blades, spaced 90° apart. In yet other examples, the bit 310 may include five, six, seven, eight, nine, ten, or more blades spaced evenly around the circumference of the bit 310. In at least one embodiment, two or more blades may be spaced unevenly around the circumference of the bit 310. In other words, two or more blades may have different angular spacing with respect to the other blades of the bit 310, which could, e.g., result in rolling cutting structures that are unevenly spaced around the bit. The blades 324 may include a fixed cutting structure 330 on the leading edge 326 of the blade 324, and a rolling cutting structure 312 at the trailing edge 328 of the blade 324. In at least one embodiment, the rolling cutting structure 312 may be at the leading edge 326 of the blade 324.

In some embodiments, each blade 324 may include a rolling cutting structure 312. In other embodiments, at least one blade 324 may not include a rolling cutting structure 312. A bit having a plurality of rolling cutting structures 312 that are not located on each blade 324 of the bit may have one, two, three, four, five, six, seven, eight, nine, ten, or more rolling cutting structures 312. The more rolling cutting structures 312 may be evenly spaced around a circumference of the bit 310. For example, the bit 310 may include two rolling cutting structures 312, spaced 180° apart. In other examples, the bit 310 may include three rolling cutting structures 312, spaced 120° apart. In yet other examples, the bit 310 may include four, five, six, seven, eight, nine, ten, or more rolling cutting structures 312 spaced evenly around the circumference of the bit 310. In at least one embodiment, two or more rolling cutting structures 312 may be spaced unevenly around the circumference of the bit 310. In other words, two or more rolling cutting structures 312 may have different angular spacing with respect to the other rolling cutting structures 312 of the bit 310. For example, the bit 310 may include two rolling cutting structures 312, spaced within 30° of 180° apart. That is, the bit 310 may include a first rolling cutting structure 312 space between 150° and 210° of a second rolling cutting structure 312. Asymmetric spacing of the rolling cutting structures 312 about the bit axis 334 may reduce harmonic vibrations while drilling.

In some embodiments, the rolling cutting structures 312 perform a majority of the formation removal during drilling, while the fixed cutting structures 330 clean up the cutting profile of the rolling cutting structures 312. In other embodiments, the fixed cutting structures 330 may perform a majority of the formation removal during drilling, while the rolling cutting structures 312 clean up the cutting profile of the fixed cutting structures 330. Including both fixed cutting structures 330 and rolling cutting structures 312 on a blade may improve the rate or penetration and/or the amount of feet drilled before refitting or repairing the bit 310. Furthermore, rolling cutting structures 312 located on the bit 310 may provide the operator with greater control of the bit, which may improve control over azimuth and inclination while drilling straight or a dogleg.

Each rolling cutting structure 312 has a journal axle axis 355, around which the rolling cutting structure 312 rotates. The journal axle axis 355 may be offset from a bit rotational axis 334 with a roller offset 336. A reference circle 337 may be centered on the bit rotational axis 334 and have a radius equal to the roller offset 336. In some embodiments, the roller offset 336 may be a percentage of the bit diameter 338. In some embodiments, the roller offset 336 percentage may be in a range having an upper value, a lower value, or upper and lower values including any of 5%, 10%, 15%, 20%, 22%, 24%, 25%, 26%, 28%, 30%, 35%, 40%, 45%, or any value therebetween. For example, the roller offset 336 percentage may be greater than 5%. In another example, the roller offset 336 percentage may be less than 45%. In yet other examples, the roller offset 336 percentage may be any value in a range between 5% and 45%. In some embodiments, a roller offset 336 percentage of 20% or greater may be critical to the operation of the bit 310.

As the roller offset 336 increases, the rotational rate of the rolling cutting structures 312 may change, and the cutting elements 316 may scrape the formation with a longer scrape as compared with lower roller offsets 336. This increased contact scraping along the formation may allow each cutting element 316 to remove more material. The conical shape of the cutting elements 316 may be wear and erosion resistant. In this manner, by using a high roller offset 336 and conical cutting elements 316, the bit 310 may experience an increased rate of penetration and/or a greater bit durability.

A reference line 357 perpendicular to the bit rotational axis 334 may extend from the bit rotational axis 334 to the journal axle axis 355. A reference circle 337 may be centered on the bit rotational axis and have a radius equal to the roller offset 336. In other words, the reference circle 337 may be circumscribed around each of the journal axle axes 355 at the roller offset 336. A tangent line 339 may be tangent to the reference circle 337 at the journal axle axis 355. A journal axle orientation angle 341 may be an angle between the journal axle axis 355 and the tangent line 339. In some embodiments, the journal axle orientation angle 341 may be in a range having an upper value, a lower value, or upper and lower values including any of 0°, 5°, 10°, 15°, 20°, 25°, 30°, 35°, 40°, 45°, or any value therebetween. For example, the journal axle orientation angle 341 may be 45° or less. In another example, the journal axle orientation angle 341 may be 30° or less. In yet other examples, the journal axle orientation angle 341 may be 15° or less. In still other embodiments, the journal axle orientation angle may be greater than 30°.

In at least one embodiment, the reference line 357, which is perpendicular to both the bit rotational axis 334 and the tangent line 339, may be a cutting element distance 311 from a cutting element tip 313. The cutting element tip 313 may be the furthest extent of the cutting element 316 from the rolling cutting structure 312, or the portion of a cutting element 316 that engages the formation first during drilling. The cutting element distance 311 may be the closest distance to the cutting element tip 313 from the reference line 357 in a plane perpendicular to the bit rotational axis 334 when the cutting element top 313 is at the bottom-most point of rotation of the rolling cutting structure 312 about the journal axis 355. In some embodiments, the cutting element distance 311 may be in a range having an upper value, a lower value, or upper and lower values including any of 0.1 in. (2.54 mm), 0.2 in. (5.08 mm), 0.3 in. (7.62 mm), 0.4 in. (10.16 mm), 0.5 in. (12.70 mm), 0.6 in. (15.24 mm), 0.7 in. (17.78 mm), 0.8 in. (20.32 mm), 0.9 in. (22.86 mm), 1.0 in. (25.40 mm), or any value therebetween. For example, the cutting element distance 311 may be greater than 0.1 in. (2.54 mm). In another example, the cutting element distance 311 may be less than 1.0 in. (25.40 mm). In yet other examples, the cutting element distance 311 may be any value in a range between 0.1 in. (2.54 mm) and 1.0 in. (25.40 mm).

The cutting element distance 311 may be offset in a positive or negative direction. The offset direction may help determine the direction that the rolling cutting structure 312 rolls about the journal 346. In other words, cutting element distance 311 may be offset in the direction of rotation of the bit (e.g., a positive offset) or against the direction of rotation of the bit (e.g., a negative offset). The direction of offset of the cutting element distance 311 may change the direction of rotation of the rolling cutting structure as the bit rotates. A positive offset may cause the rolling cutting structure 312 to rotate from the center of the bit (e.g., from the bit rotational axis or near the bit rotational axis) toward the outside or the gauge of the bit. A negative offset may cause the rolling cutting structure 312 to rotate from the outside or the gauge of the bit toward the center of the bit. In some embodiments, a rotation from the center of the bit toward the outside or gauge of the bit may be desired as material removed by the cutting elements 316 may be pushed away from the bit rotational axis and the central fluid port (e.g., the central fluid port 340 of FIG. 3-2), thereby helping to prevent clogging the central fluid port. In some embodiments, a first rolling cutting structure 312 is arranged on the bit 310 with a positive offset and a second rolling cutting structure 312 is arranged on the bit 310 with a negative offset, thereby configuring the first rolling cutting structure and the second rolling cutting structure to rotate in opposite directions.

The bit 310 may include a central fluid port 340. In some embodiments, the central fluid port 340 may be located at the bit rotational axis 334. In other embodiments, the central fluid port 340 may be located at the juncture or the center of all of the slots 348 for the rolling cutting structures 312. In this manner, the central fluid port 340 may flush cuttings from the rolling cutting structures 312. Furthermore, the central fluid port 340 may clean the rolling cutting structures 312. In some embodiments, the bit 310 may include more than one central fluid port 340 in the central cavity 385. For example, the bit 310 may include the same number of central fluid ports 340 as rolling cutting structures 312. In other examples, the bit 310 may include more central fluid ports 340 than rolling cutting structures 312. In still other examples, the bit 310 may include fewer central fluid ports 340 than rolling cutting structures 312. In some embodiments, the central fluid port 340 may include a nozzle that pressurizes and directs the flow of drilling fluid out of the bit 310. In other embodiments, the central fluid port 340 may not include a nozzle, but may vent directly from a fluid chamber inside the body of the bit.

The bit 310 may include a blade nozzle 342. The blade nozzle 342 may be located in a depression or junk slot between blades 324. In some embodiments, the blade nozzle 342 may direct drilling fluid across the fixed cutting structure 330. This may help wash cuttings away from the fixed cutting structure 330 and clean the cutting elements of the fixed cutting structure 330. In some embodiments, each blade 324 may have a blade nozzle 342. In some embodiments, each blade 324 may include more than one blade nozzle 342 to better clean the fixed cutting structure.

The blade 324 may include a support leg 344 at the trailing edge 328 of the blade 324. The support leg 344 may support an end of the rolling cutting structure 312. For example, a journal axle may be inserted into a cavity in the blade 324 at the leading edge 326 or the trailing edge 328. A first end of the journal axle may be supported by the leading edge 326 of the blade 324, and a second end of the journal axle may be supported by the support leg 344.

FIG. 3-3 is a cross-sectional view of a blade 324, according to at least one embodiment of the present disclosure. The blade 324 may include a journal cavity 331 and a rolling slot 348. The rolling slot 348 may be wide enough to allow a rolling cutting structure 312 to be inserted into the rolling slot 348. To secure the rolling cutting structure 312 to the blade 324, the journal 346 may be inserted into the journal cavity 331 and through a journal bore 318 in the rolling cutting structure 312 when the rolling cutting structure 312 is inserted in the rolling slot 348.

In some embodiments, the journal 346 may be secured to the blade 324 with a journal attachment 350. The journal attachment may include a threaded fastener 351, such as a screw or a bolt. The threaded fastener 351 may be inserted through a bolt hole 352 and into matching threads in the journal 346. As the threaded fastener 351 is tightened, the journal 346 may be drawn towards the bolt hole 352. A washer 353 may spread the load of the tightened threaded fastener 351 across the bolt hole 352. Thus, the journal 346 may be securely fastened to the blade 324 in the journal cavity 331. The threaded fastener 351 may be accessed through a bolt cavity 333 in the blade 324.

In some embodiments, the journal cavity 331 may extend across the rolling slot 348 to the other side (i.e., trailing edge 328) of the blade 324. Therefore, the journal 346 may be supported on both a journal first end 354-1 and a journal second end 354-2. The blade 324 may include a support leg 344 located at a trailing edge 328 of the blade 324. The bolt cavity 333 and the bolt hole 352 may be located in the support leg 344, and the journal cavity 331 may extend into the support leg 344. Thus, the journal 346 may be inserted into the journal cavity 331, inserted through the journal bore 318 of the rolling cutting structure 312, inserted into a portion of the journal cavity 331 on the support leg 344, and secured to the blade 324 at the journal attachment 350. In this manner, the journal 346 may be supported at the journal first end 354-1 near or at the leading edge 326 and at the journal second end at the support leg 344 near or at the trailing edge 328. Because the journal 346 supports the rolling cutting structure 312, the rolling cutting structure 312 is supported by the blade near the leading edge 326 and by the support leg 344 near or at the trailing edge 328.

In at least one embodiment, the blade 324 may not include a support leg 344. In this manner, the journal cavity 331 may extend through the blade 324, and the rolling cutting structure 312 may be cantilevered out in the trailing direction behind the blade 324. For example, the journal cavity 331 may be strengthened using hardened materials or additively manufactured structures internal to the leading edge of the blade 324. This may account for any additional forces caused by the cantilevered rolling cutting structure 312 on the blade 324.

In some embodiments, the journal cavity 331 may be located on the leading edge 326 of the blade 324. For example, the journal cavity 331 may be located below the fixed cutting structure 330 on the leading edge 326 of the blade 324. The bolt cavity 333 may be located on the support leg 344, or in other words, on the trailing edge 328 of the blade 324. In other embodiments, the journal cavity 331 may be located on the trailing edge 328 of the blade 324, and the bolt cavity 333 may be located on the leading edge 326 of the blade 324.

In some embodiments, the journal 346 may be a journal axle. Grease for the journal 346 may be located in a grease reservoir 356. The grease reservoir 356 may be integrally formed within the journal 346 or may be a separate component disposed within the journal 346. Grease may be communicated to the journal axle through grease ports 358 in the journal 346. The journal 346 may have an increased diameter or cross-sectional area in the section of the cavity 331 that supports the journal 346. This may increase the volume of the grease reservoir 356, thereby allowing greater lubrication and/or operational lifetime of the journal 346. In at least one embodiment, the grease reservoir 356 may be offset from the journal axle axis 355 to accommodate placement of one or more of the grease ports 358. The journal axle may include a sleeve that extends around an exterior of the journal 346. In some embodiments the sleeve may extend at least partially into the journal cavity 331. The sleeve may help to secure the journal 346 in place and spread any load experienced by the journal 346. A compensation hole 364 through the journal 346 and the journal attachment 350 may facilitate distribution of the grease from the reservoir 356 by exposure to the downhole pressure. Additionally, a fastener 365 (e.g., snap ring) may be configured to secure the grease reservoir 356 within the journal 346.

In some embodiments, a plurality of bearings 323 are disposed in bearing races 325 between the rolling cutting structure 312 and the blade 324. In some embodiments, a friction bearing provides axial support along the journal axis 355 between the rolling cutting structure 312 and the portions of the blade 324 along the slot 348. As noted above with FIG. 2-2, thrust washers 360 may be arranged in thrust washer cavities 327 of the rolling cutting structure 312. These thrust washers 360 and bearings 323 may be configured to center the rolling cutting structure within the slot 348. In some embodiments, the thrust washers 360 are radially outside the bearings 323 or friction bearing. One or more journal seals 361 are configured to reduce or eliminate intrusion of drilling fluid into the journal system. In some embodiments, one or more reservoir seals 362 are configured to isolate the grease within the journal. The journal seals 361 and reservoir seals 362 may include, but are not limited to o-rings, oval seals, bullet seals, or other types of seals.

The cutting elements 316 of the rolling cutting structure 312 may have an exposure, which is a distance that the cutting elements 316 may cut into the formation. Furthermore, the fixed cutting elements 332 of the fixed cutting structure 330 may have an exposure. In some embodiments, the fixed cutting elements 332 exposure may be the same as the cutting elements 316 exposure. In some embodiments, the fixed cutting elements 332 exposure may be different than the cutting elements 316 exposure. The differing exposures may be seen in a view where the fixed cutting elements 332 and the cutting elements 316 are rotated into the same plane about the bit axis 334 for comparison.

For example, the cutting elements 316 of the rolling cutting structure 312 may have a greater exposure than the fixed cutting elements 332. In other words, the cutting elements 316 may extend further into the formation than the fixed cutting elements 332 at a given location. Therefore, in at least one embodiment, the cutting elements 316 extend past the end of the bit 310 further than the fixed cutting elements 332. In this manner, the cutting elements 316 may cut more of the formation than the fixed cutting elements. In some embodiments, the fixed cutting elements 332 may clean up the wellbore bottom from material left uncut by the cutting elements 316.

The cutting elements 316 exposure may be positive or negative. As used in this disclosure, a positive exposure is the extent the cutting elements 316 extends past the other cutting elements (e.g., the fixed cutting elements or cutters on the other rolling cutting structures). A negative exposure is the extent below the other cutting elements (e.g., the fixed cutting elements or cutters on the other rolling cutting structures) that the cutting elements 316 may be positioned. In some embodiments, the cutting elements 316 exposure may be in a range having an upper value, a lower value, or upper and lower values including any of −0.300 in. (−7.62 mm), −0.250 in. (−6.35 mm), −0.200 in. (−5.08 mm), −0.150 in. (−3.81 mm), −0.100 in. (−2.54 mm), −0.075 in. (−1.91 mm), −0.050 in. (−1.27 mm), −0.025 in. (−0.64 mm), 0.025 in. (0.64 mm), 0.050 in. (1.27 mm), 0.075 in. (1.91 mm), 0.100 in. (2.54 mm), 0.150 in. (3.81 mm), 0.200 in. (5.08 mm), 0.250 in. (6.35 mm), 0.300 in. (7.62 mm), or any value therebetween. For example, the cutting elements 316 exposure may be greater than −0.300 in. (−7.62 mm). In another example, the cutting elements 316 exposure may be less than 0.300 in. (7.62 mm). In yet other examples, the cutting elements 316 exposure may be any value in a range between −0.300 in. (−7.62 mm) and 0.300 in. (7.62 mm). In some embodiments, the cutting elements 316 exposure could be less than −0.300 in. (−7.62 mm) or greater than 0.300 in. (7.62 mm). In at least one embodiment, it may be critical that the exposure is between −0.050 in. (−1.27 mm) and 0.050 in. (1.27 mm) to provide the maximum rate of penetration and prevent excessive wear of the cutting elements 316. In some embodiments, different rolling cutting structures 312 may have different exposures. For example, one or more rolling cutting structures 312 may have a negative exposure, one or more rolling cutting structure 312 may have a positive exposure, and one or more rolling cutting structure 312 may have an exposure of 0 in. (0 mm), or any combination thereof.

In some embodiments, the cutting elements 316 exposure may be adjustable. For example, a larger diameter rolling cutting structure 312 may increase the exposure of the cutting elements 316. In other examples, larger cutting elements 316 may increase the exposure of the cutting elements 316. In some examples, a combination of changing the diameter of the rolling cutting structure 312 and the size of the cutting elements 316 may change the exposure of the cutting elements 316.

The journal 346 has a journal axle axis 355. The rolling cutting structure 312 may rotate about the journal 346 on a journal axle about the journal axle axis 355. In some embodiments, the journal axle axis 355 may be parallel to a reference line 357, the reference line 357 being perpendicular to a bit rotational axis (such as the bit rotational axis 334 of FIG. 3-2). A journal angle 359 may be the angle between the journal axle axis 355 and the reference line 357. In some embodiments, the magnitude of the journal angle 359 may be in a range having an upper value, a lower value, or upper and lower values including any of 0°, 5°, 10°, 11°, 12°, 13°, 14°, 15°, 16°, 17°, 18°, 19°, 20°, 21°, 22°, 23°, 24°, 25°, 30°, 35°, 40°, 45° or any value therebetween. For example, the journal angle 359 may be greater than 0°. In another example, the journal angle 359 may be less than 45°. In yet other examples, the journal angle 359 may be any value in a range between 0° and 45°. In some embodiments, the journal angle 359 may be greater than 45°.

In some embodiments, the journal angle 359 may affect the angle at which the cutting elements 316 engage the formation. Therefore, the journal angle 359 may be optimized for the angle at which the cutting elements 316 engage the formation. A journal angle of 17° or within 10° of 17° may be critical to optimize the drilling of the bit. The journal angle 359 may be positive or negative. In some embodiments, the cutting elements 316 may be attached to the rolling cutting structure to affect the angle at which the cutting elements 316 engage the formation. For example a first row of cutting elements 316 may be arranged with cutting element axes perpendicular to the axis of the rolling cutting structure 312, and a second row of cutting elements 317 may be arranged with cutting element axes at a different angle to the axis of the rolling cutting structure. Thus, in some embodiments, the cutting elements 316 of the rolling cutting structure 312 may be attached to provide a desired angle of engagement with the formation regardless of the journal angle 359.

Figures 3, 4:
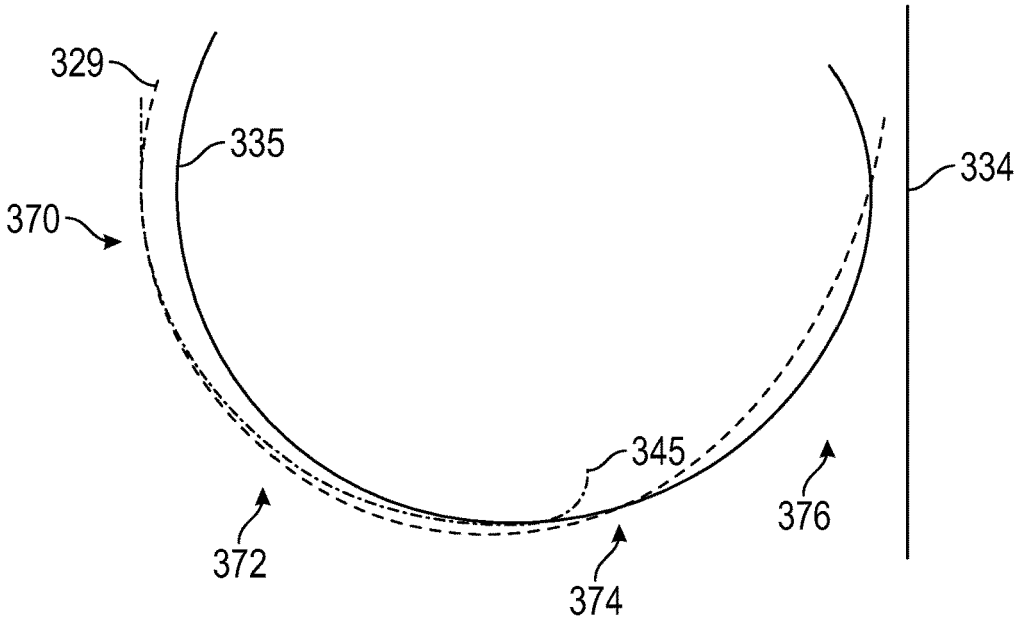
Figures 3, 4, 5:
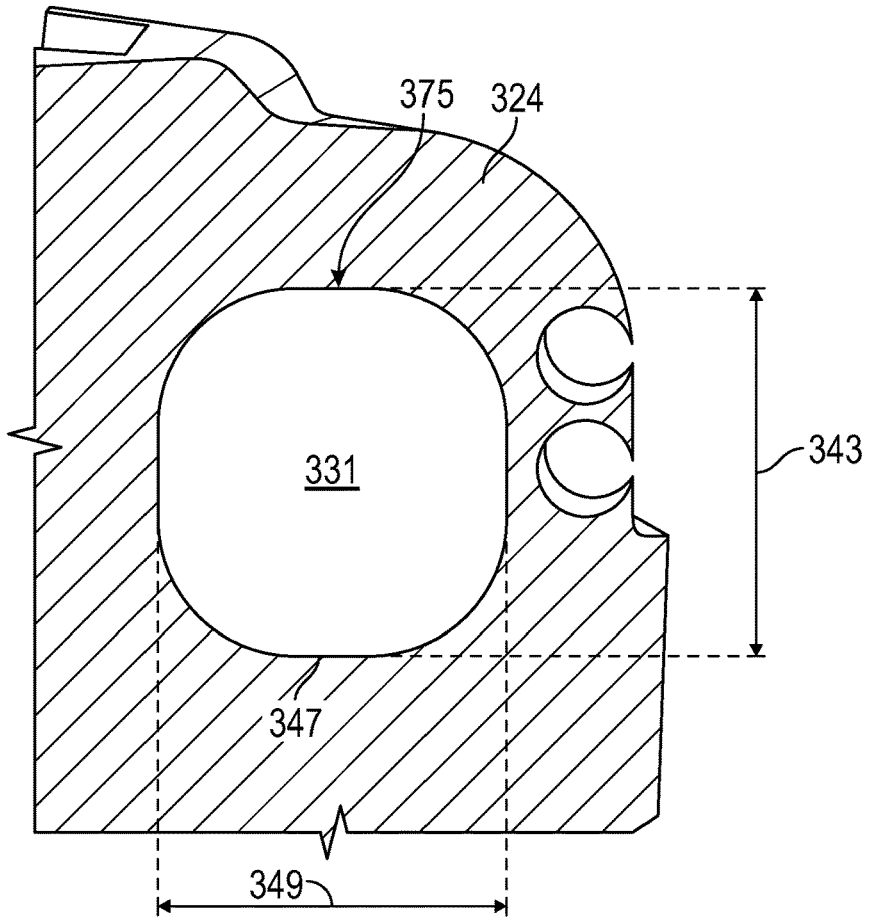
Figure 4:
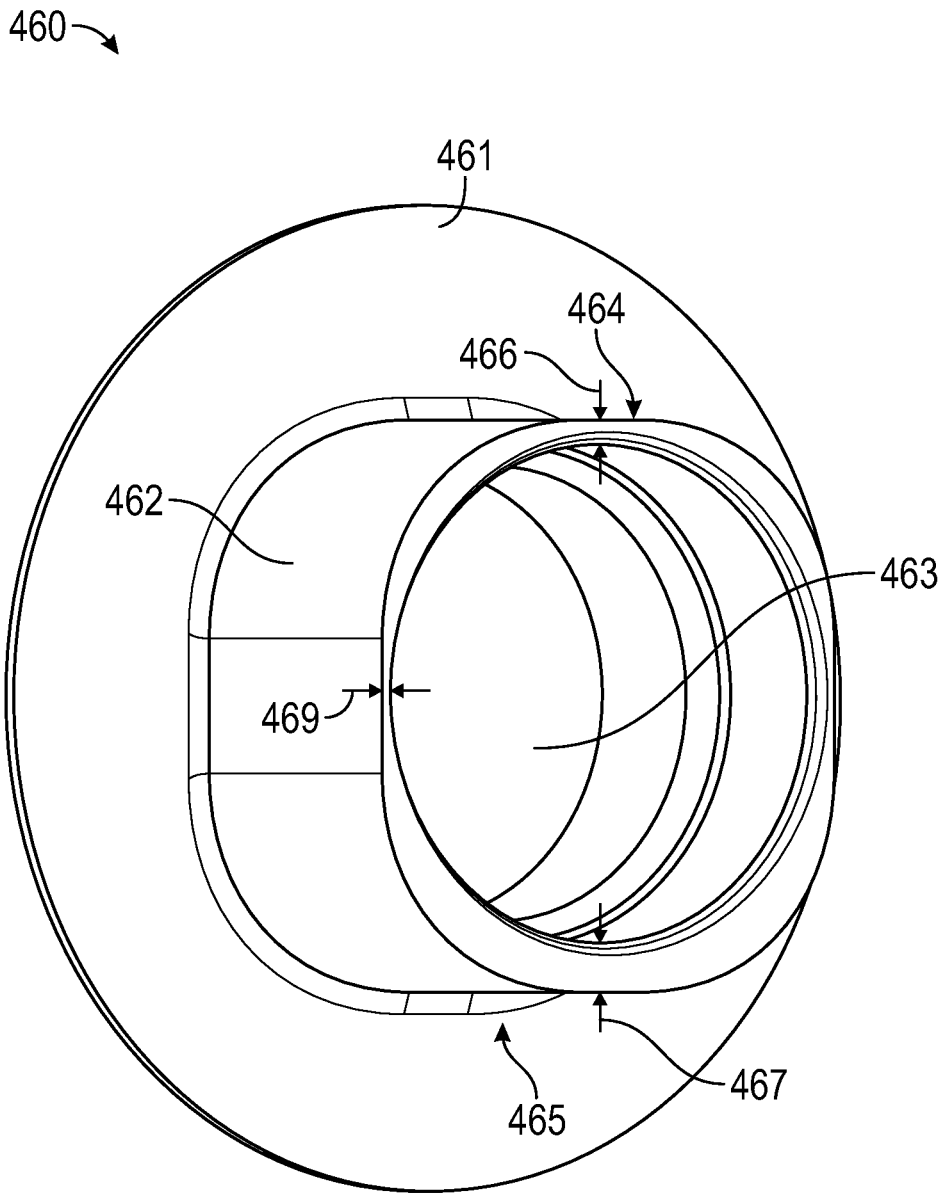
Figures 1, 5:
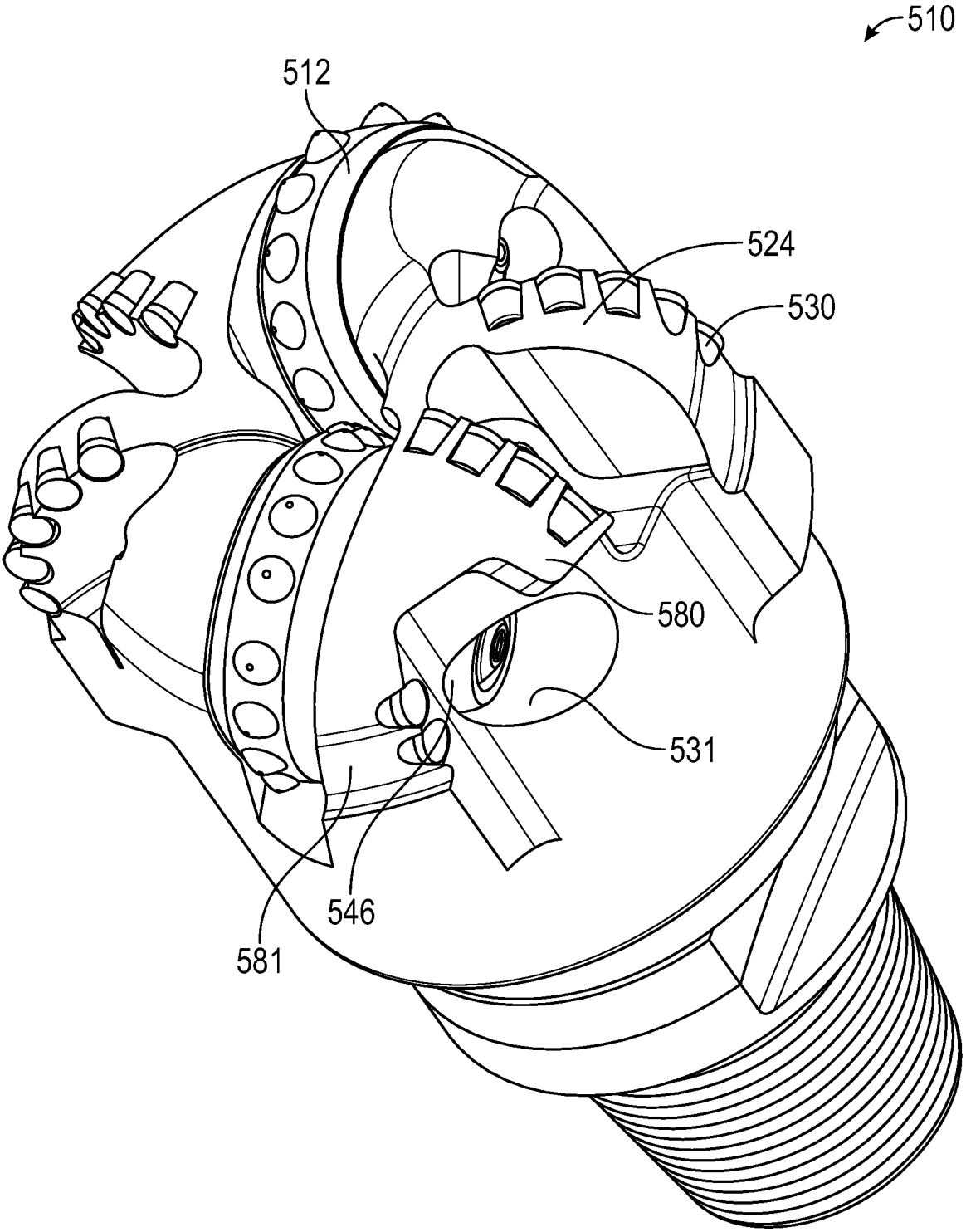
Figures 2, 5:
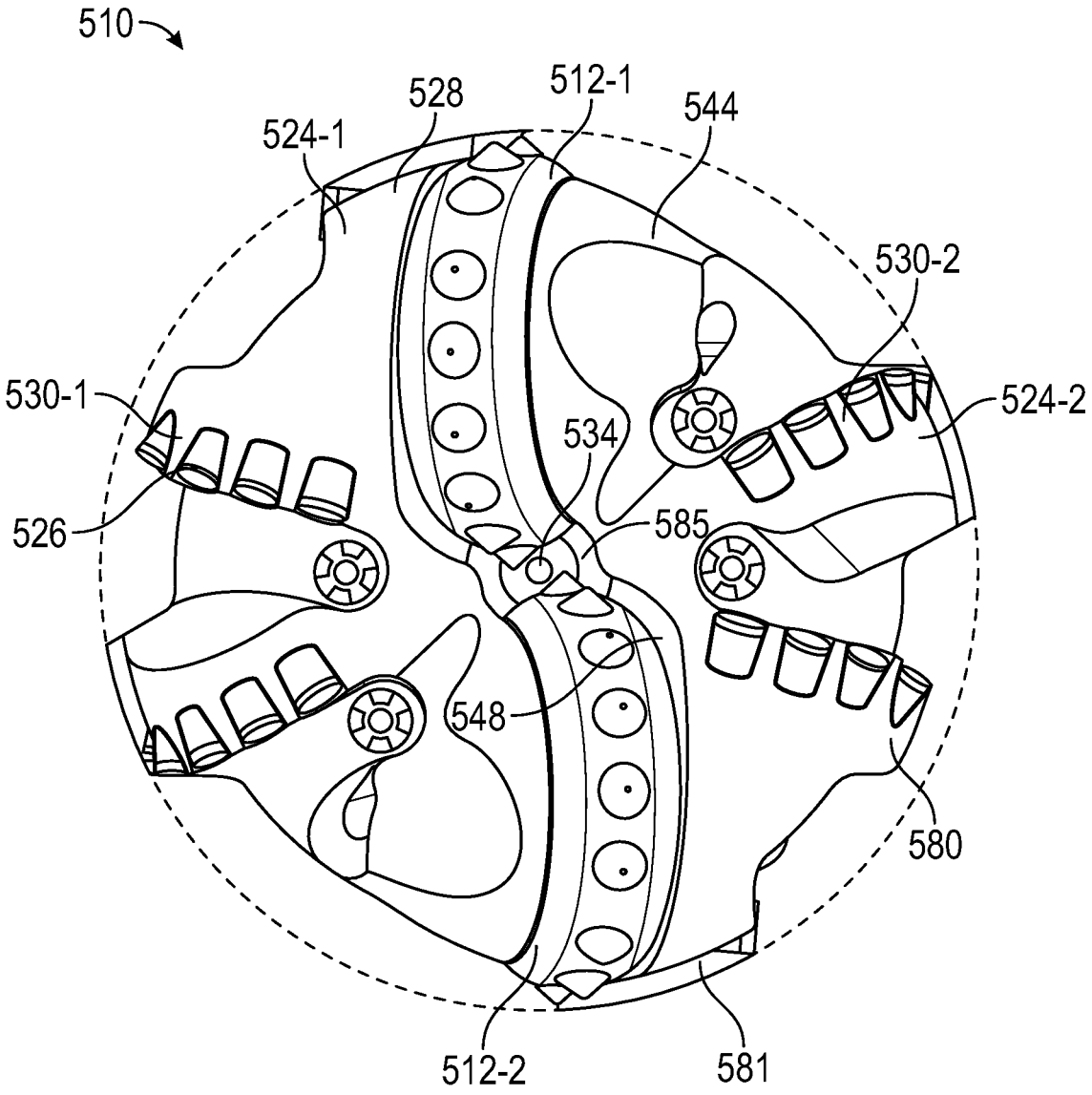
Figures 3, 5:
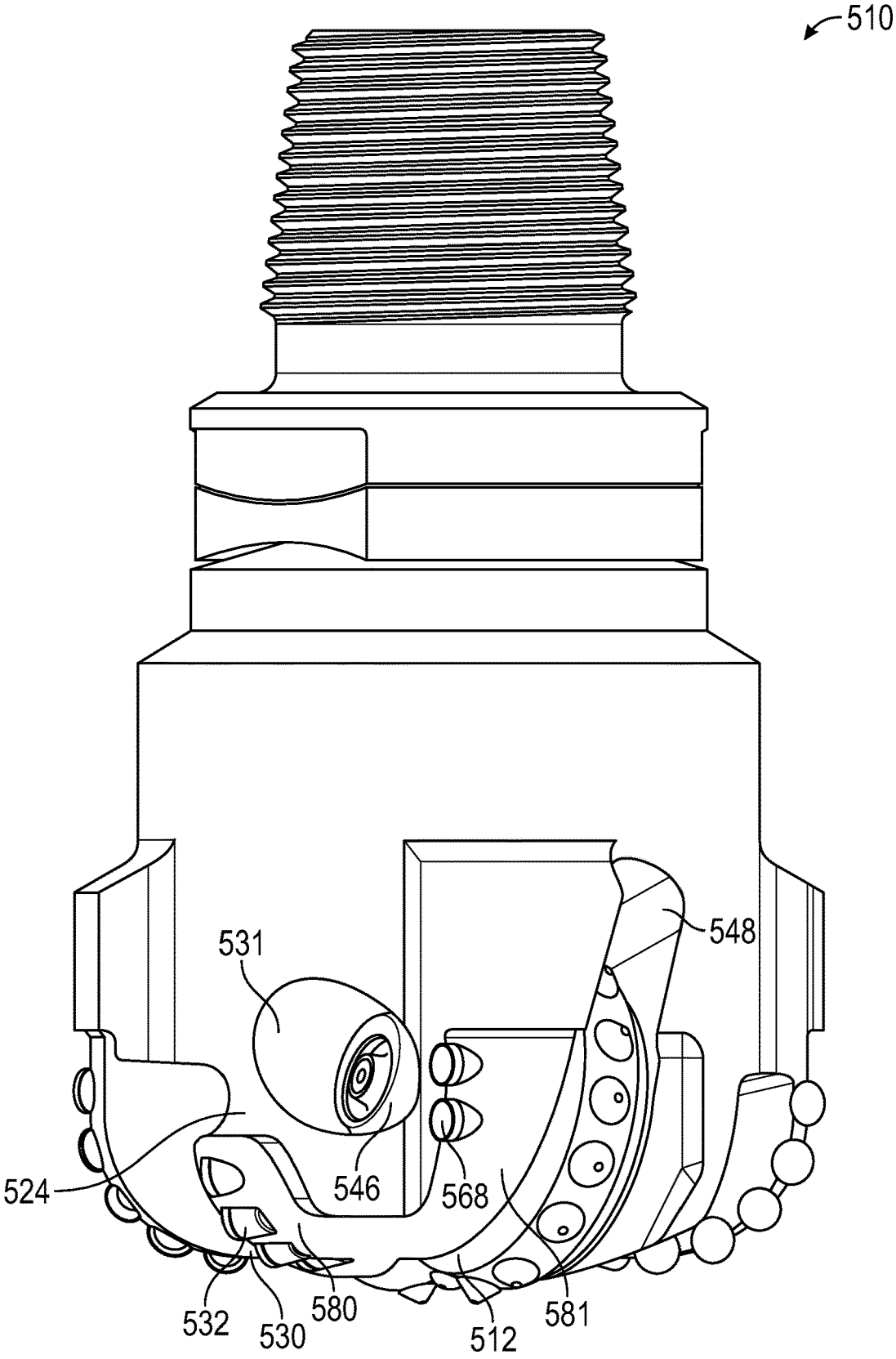

FIG. 3-4 is a cutting-element profile of the bit 310 of FIG. 3-1, according to at least one embodiment of the present disclosure. A cutting element profile 329 represents the outermost extent of the cutting elements (e.g., cutting elements 316 of FIG. 3-2) on a rolling cutting structure (e.g., rolling cutting structure 312 of FIG. 3-2), as rotated about a bit rotational axis 334. A secondary cutting element profile 335 represents the outermost extent of the secondary cutting elements (e.g., secondary cutting elements 217 of FIG. 2-1), as rotated about the bit rotational axis 334. A fixed cutting element profile 345 represents the outermost extent of the fixed cutting elements (e.g., fixed cutting elements 332 of FIG. 3-3), as rotated about the bit rotational axis 334.

As may be seen, the cutting element profile 329 extends the furthest downward, or has the highest exposure approximately halfway between the bit rotational axis 334 and the borehole wall. The cutting elements that have the highest exposure may experience the greatest forces and remove a majority of the formation while drilling. Thus, the cutting element profile 329 indicates that the cutting elements perform most of the cutting in the bit. In other embodiments the fixed cutting element profile 345 may extend further downward than the cutting element profile 329. Thus, the fixed cutting element profile would cut the majority of the formation in the region halfway between the borehole wall and the bit axis 334. From a center portion of the profiles inside of where the fixed cutting element profile 345 extends the furthest downward, the cutting element profile 329 may extend further downward than the secondary cutting element profile 335 and would therefore cut the majority of the formation in this zone.

The exposure of the cutting elements 316 of the one or more rolling cutting structures 312 may differ from the exposure of the fixed cutting elements 332 on the blades 324. The fixed cutting elements 332 may be configured to engage the formation in one or more of a gauge section 370, a shoulder section 372, a nose section 374, or any combination thereof. In some embodiments, the fixed cutting elements 332 on the blades 324 may be configured to not engage with the formation in a cone region 376 of the bit nearest the bit axis 334. As illustrated in FIG. 3-4, the exposure 345 of the fixed cutting elements 322 may not include the cone region 376 nearest the bit axis 334. FIGS. 3-1 and 3-2 illustrate embodiments of the bit 310 without fixed cutting elements in the cone region 376. That is, the cutting elements 316 of the rolling cutting structures 312 may be the only cutting structures within the cone region 376. One or more rows of the cutting elements 316 may have exposure to the formation in at least the cone region 376. The exposures 329 and 335 of the cutting elements 316 on the rolling cutting structures 312 may overlap with the exposure 345 of the fixed cutting elements 332 in one or more of the nose region 374, the shoulder region 372, and the gauge region 370. In some embodiments, the exposures 329 and 335 of the cutting elements 316 on the rolling cutting structures 312 are less than or equal to the exposure 345 of the fixed cutting elements 332 wherever the respective exposures overlap.

FIG. 3-5 is a cross sectional view of the blade 324 of FIGS. 3-2 and 3-3 taken transverse to the view shown in FIG. 3-3, according to at least one embodiment of the present disclosure. The journal cavity 331 has a journal cavity height 343 extending from a journal cavity top 375 to a journal cavity bottom 347. The journal cavity 331 further has a journal cavity width 349.

In some embodiments, the journal cavity 331 may have a generally circular cross section. In other embodiments, the journal cavity 331 may have cross section with a domed top section and a domed bottom section, with a straight middle section. In still other embodiments, the journal cavity may have an ellipsoidal cross section. In yet other embodiments, the journal cavity 331 may be approximately rectangular shaped, or rectangular with rounded corners. In still other embodiments, the journal cavity 331 may have a cross-section that is polygonal, including polygons of 5 or more sides.

In some examples, the journal cavity width 349 may be the same as the journal cavity height 343. For example, the journal cavity 331 may be approximately square or circular. In other examples, the journal cavity 331 may be rectangular or ellipsoidal, meaning that journal cavity width 349 may be less than the journal cavity height 343. In some embodiments, a rectangular journal cavity 331 may have a more favorable force distribution for the forces experienced by the blade 324.

FIG. 4 is an embodiment of a sleeve 460, according to at least one embodiment of the present disclosure. The sleeve 460 may include a back plate 461. In some embodiments, the back plate 461 may be configured to abut against an inner surface of a rolling cavity (e.g., rolling slot 348 of FIG. 3-2). In some embodiments, two sleeves 460 may be placed on either side of a rolling slot (e.g., rolling slot 348 of FIG. 3-3). Thus, a plurality of sleeves may be configured to support a rolling cutting structure (e.g., rolling cutting structure 212 of FIG. 2-1).

A sleeve extension 462 may extend from the back plate 461 with the sleeve extension journal bore 463 extending therethrough. The sleeve extension has a top surface 464 and a bottom surface 465. A top thickness 466 may be the thickness of the sleeve extension 462 between the sleeve extension journal bore 463 and the top surface 464. A bottom thickness 467 may be the thickness of the sleeve extension 462 between the journal bore and the bottom surface 465.

In some embodiments, the sleeve 460 may have an outer profile that matches the profile of the journal cavity (e.g., journal cavity 331 of FIG. 3-5), and an inner profile that matches the outer circumference of the journal (e.g., journal 346 of FIG. 3-3). Therefore, the profile of the journal cavity may be different than the profile of the journal. In this manner, the sleeve 460 may distribute the forces experienced by the rolling cutting structure to the journal cavity. Thus, the journal cavity may be designed to distribute forces from the rolling cutting structure (e.g., the rolling cutting structure 312 of FIG. 3-1) to the blade, and the sleeve 460 may be designed to nest the journal within the journal cavity, and to transfer forces experienced by the journal from the rolling cutting structure to the journal cavity.

In some embodiments, the top thickness 466 may be the same as the bottom thickness 467. In other embodiments, the top thickness 466 may be different from the bottom thickness 467. In this manner, the relative position of the journal within the journal cavity may be adjusted by providing sleeves 460 with differing top thicknesses 466 and bottom thicknesses 467. In other words, the height of the journal within the journal cavity may be adjusted by changing the sleeve 460 to a sleeve 460 having a different top thickness 466 and a different bottom thickness 467. Therefore, the rolling cutting structure may have an adjustable height. This may allow the height of the rolling cutting structure to be changed with respect to the rest of the bit. Specifically, the height or position of the rolling cutting structure with respect to the fixed cutting structure may be changed. In other words, the exposure of the cutting elements (e.g., cutting elements 316 of FIG. 3-3) may be changed or adjusted relative to the fixed cutting elements (e.g., fixed cutting elements 332 of FIG. 3-3) by changing the sleeve 460. In other embodiments, other adjustment mechanisms may be used. For example, a ratcheting mechanism, a flow control valve, a stepper motor, or other adjustment mechanism may be used to adjust the height of the journal. Examples of adjustment mechanisms may be seen in United States Patent Publication Number 2018/0087323, filed Mar. 27, 2016, which is hereby incorporated by reference in its entirety for all purposes.

Similarly, a side thickness 469 of the sleeve 460 may be adjusted. In this manner, the offset (e.g., roller offset 336 of FIG. 3-2) may be adjusted. In other words, the offset of the rolling cutting structure may be adjustable. For example, a sleeve 460 having different side thicknesses 469 may be inserted into the journal cavity, thereby changing the offset of the rolling cutting structure. In some embodiments, the side thickness 469, the top thickness 466, and the bottom thickness 467 may be changed at the same time. In other words, both the journal offset and the journal height may be adjusted at the same time.

In some embodiments, the sleeve 460 may be reversible. In other words, the sleeve 460 may be able to be installed such that the top surface 464 engages a bottom surface of the journal cavity and a bottom surface 465 may engage a top surface of the journal cavity, and vice versa. In this manner, the height and exposure of the journal and the rolling cutting structure may be quickly adjusted, e.g., in the field at the drill rig.

FIG. 5-1 is a perspective view of a representation of a bit 510, according to at least one embodiment of the present disclosure. The bit 510 may include at least some of the same features and characteristics as the rolling cutting structures and bits described in relation to FIG. 2-1 through FIG. 4. The bit 510 may include a plurality of blades 524. In the embodiment shown, the bit 510 includes a plurality of fixed cutting structures 530 and rolling cutting structures 512. The rolling cutting structures 512 may be attached to a blade 524 using a journal 546 installed in a journal cavity 531. The fixed cutting structures of a blade 524 with a rolling cutting structure 512 may be split into an upper blade section 580 and a lower blade section 581 to facilitate the journal cavity 531. The upper blade section 580 and the lower blade section 581 may each have a plurality of fixed cutting elements arranged thereon.

FIG. 5-2 is a bottom view of the bit 510 of FIG. 5-1. As may be seen, in some embodiments, the bit 510 may include four blades (collectively 524). A first blade 524-1 may include a first fixed cutting structure 530-1 at a leading edge 526 of the first blade 524-1. A rolling cutting structure (collectively 512) may be attached to the first blade 524-1 at a trailing edge 528. The rolling cutting structure 512 may be attached to the first blade 524-1 and supported by a support leg 544. A second blade 524-2 may include a single cutting structure, i.e., the second fixed cutting structure 530-2. In some embodiments, slots 548 for the rolling cutting structures 512 may be open to a central cavity 585, as shown in FIG. 5-2.

In some embodiments, the bit 510 include a first set of blades and a second set of blades. The first set of blades may include two or more first blades 524-1. The second set of blades may include two or more second blades 524-2.

The bit 510 may have twice as many fixed cutting structures (collectively 530) as rolling cutting structures 512. In some embodiments, a secondary blade, or fixed cutting structure 530, may be located on either side or both sides of each rolling cutting structure 512. In other words, each fixed cutting structure 530 may have a rolling cutting structure 512 located on a first side of the fixed cutting structure 530, and a fixed cutting structure 530 on a second side of the fixed cutting structure.

In some embodiments, the first blade 524-1 may only include a rolling cutting structure 512, without a first fixed cutting structure 530-1. In such an embodiment, the bit 510 has six blades 524, each blade 524 including a single cutting structure.

In some embodiments, the bit 510 may include a first rolling cutting structure 512-1 and a second rolling cutting structure 512-2. Both rolling cutting structures 512-1, 512-2 may have a journal angle (e.g., journal angle 359 of FIG. 3-3). Because the first rolling cutting structure 512-1 is located on the opposite side of the bit 510 from the second rolling cutting structure 512-2, the first rolling cutting structure 512-1 appears to be angled in a different direction from the second rolling cutting structure 512-2. However, the rolling cutting structures 512-1, 512-2 are angled in the same rotational direction. However, in some embodiments, because of the journal angle, the formation may not be completely worn away near the bit rotational axis 534. In some embodiments, a separation distance between cutting elements across the bit rotational axis 534 may be between 0 to 1.0 inches, 0.25 to 0.75 inches, 0.3 to 0.6 inches, or approximately 0.5 inches. Therefore, the rolling cutting structures 512-1, 512-2 may include a second row of secondary cutting elements (e.g., the secondary cutting elements 217 of FIG. 2-1). These secondary cutting elements may assist in removing the formation at the bit rotational axis 534.

FIG. 5-3 is a side view of the bit 510 of FIG. 5-1, according to at least one embodiment of the present disclosure. As discussed above, the rolling cutting structure 512 may be secured to the bit 510 using a journal 546 installed in a journal cavity 531. In some embodiments, the journal cavity may be installed in a slot 548 of a blade 524 below a fixed cutting structure 530. However, this may reduce the amount of available room for fixed cutting elements 532 on the fixed cutting structure 530. Therefore, in some embodiments, one or more gauge cutting elements 568 may be located near or above the rolling cutting structure 512. Thus, in at least one embodiment, the fixed cutting structure 530 may have a set of fixed cutting elements 532 located separately from the gauge cutting elements 568. That is, the fixed cutting structure 530 of the blade 524 may have the upper blade section 580 and the lower blade section 581

Figure 6:
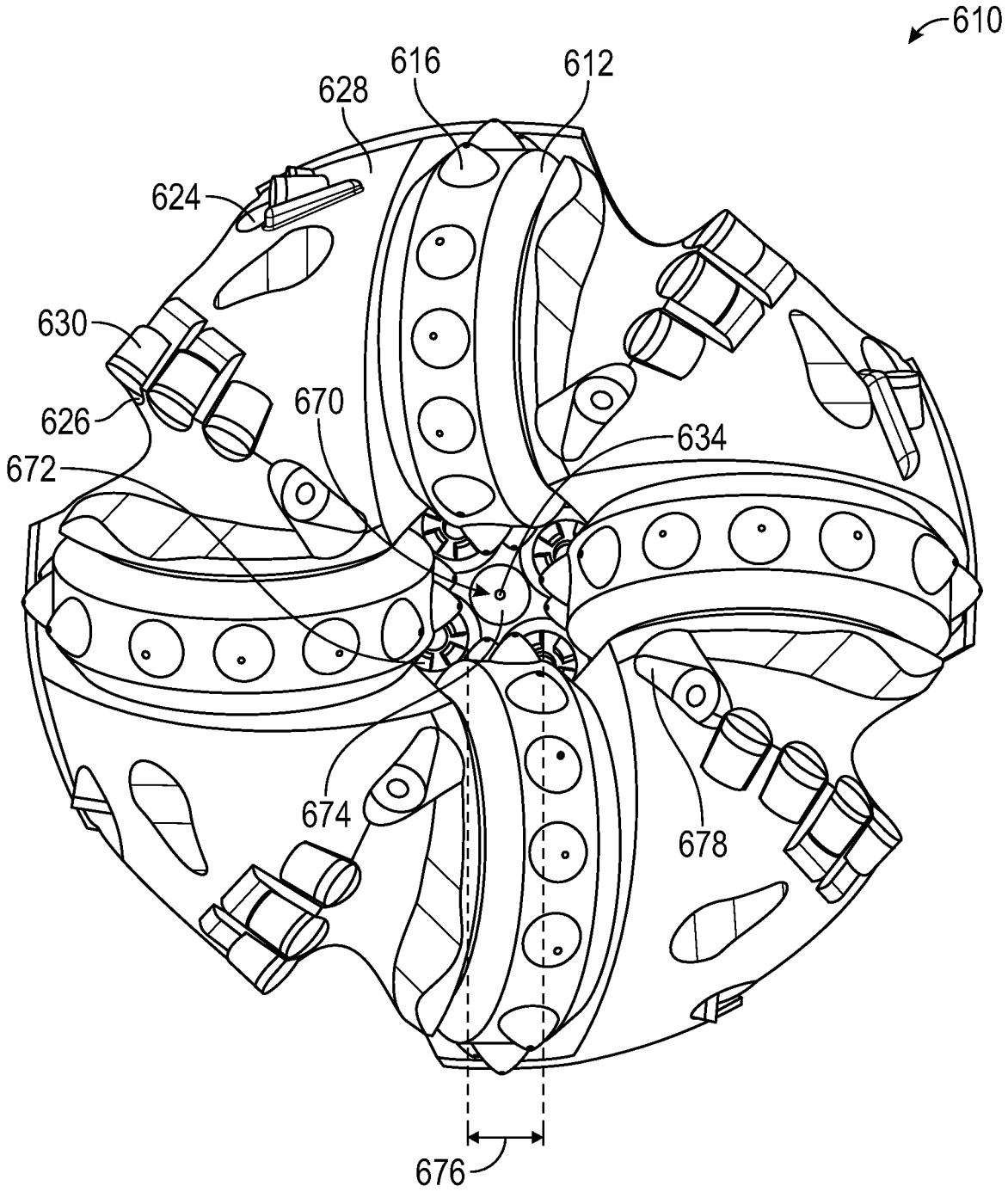
FIG. 6 is a bottom view of a bit, according to at least one embodiment of the present disclosure.

FIG. 6 is a bottom view of a representation of a bit 610, according to at least one embodiment of the present disclosure. The bit 610 may include at least some of the same features and characteristics as the rolling cutting structures and bits described in relation to FIG. 2-1 through FIG. 5-3. The bit 610 may include a plurality of blades 624. Each blade 624 may include a fixed cutting structure 630 on a leading edge 626 and a rolling cutting structure 612 on a trailing edge 628 of the blade 624.

In this manner, the bit 610 may include an equal number of fixed cutting structure 630 to rolling cutting structures 612. In other words, a fixed cutting structure 630 may be located on either side of each rolling cutting structure 612, and a rolling cutting structure 612 may be located on either side of each fixed cutting structure 630.

A central gap 670 (e.g., central cavity) may be located at the convergence of the plurality of rolling cutting structures 612. The central gap 670 may include a plurality of central fluid jets 672. The plurality of central fluid jets 672 may be directed at the rolling cutting structures 612 such that the central fluid jets 672 clean the rolling cutting structures 612 and flush cuttings from the central gap 670. In some embodiments, the bit 610 may include a central fluid jet 672 for each rolling cutting structure 612. In other embodiments, there may be more central fluid jets 672 than rolling cutting structures. In still other embodiments, there may be fewer central fluid jets 672 than rolling cutting structures.

In some embodiments, the cutting elements 616 may not reach completely to the center of the bit 610. Therefore, there may be a separation distance 676 between two opposing rolling cutting structures 612. This separation distance 676 may be a result of the journal offset, the journal angle, the placement of the rolling cutting structures 612 in general, or any combination of the foregoing. In some embodiments, one or more central cutting elements 674 may be placed on the bit 610 at the center of the central gap 670 to break up any formation that is not broken by the rolling cutting structure 612. The separation distance 676 may be between approximately 0.1 to 1.0 inches, 0.25 to 0.75 inches, 0.3 to 0.6 inches, or approximately 0.5 inches. In some embodiments, the separation distance 676 between opposing rolling cutting structures 612 may be negative. That is, the cutting elements 616 of the opposing rolling cutting structures 612 may overlap a plane through the bit axis 634 such that the cutting profile extends across the bit axis 634. These rolling cutting structures 612 are arranged on different planes, which is configured to eliminate interference of the cutting elements 616.

In other embodiments, two opposing rolling cutting structures 612 may be placed or adjusted to reduce the separation distance 676. For example, two opposing rolling cutting structures 612 may be placed with a smaller roller offset than the other two rolling cutting structures 612. In other examples, two opposing rolling cutting structures 612 may have larger wheel diameters (e.g., wheel diameter 220 of FIG. 202) than the other two rolling cutting structures 612. In still other examples, some combination of rolling cutting structure placement, wheel diameter, and a central cutting element 674 may help to break up the formation not cut in the central gap 670.

A blade nozzle 678 may be located between each blade 624. The blade nozzle 678 may be configured to clean the fixed cutting structure 630. In some embodiments, the blade nozzle 678 may be oriented at a blade nozzle angle, relative to the bit rotational axis 634. In some embodiments, the blade nozzle angle may be parallel to the bit rotational axis 634. In other embodiments, the blade nozzle angle may be in a range having an upper value, a lower value, or upper and lower values including any of 5°, 10°, 15°, 20°, 25°, 30°, 35°, 40°, 45°, 50°, 55°, 60°, 65°, 70°, 75°, 80°, 85°, or any value therebetween. For example, the blade nozzle angle may be greater than 5°. In another example, the blade nozzle angle may be less than 85°. In yet other examples, the blade nozzle angle may be any value in a range between 5° and 85°. In some embodiments, a blade nozzle angle of approximately 45° may be critical to effectively clean the fixed cutting structures 630.

Figures 1, 7:
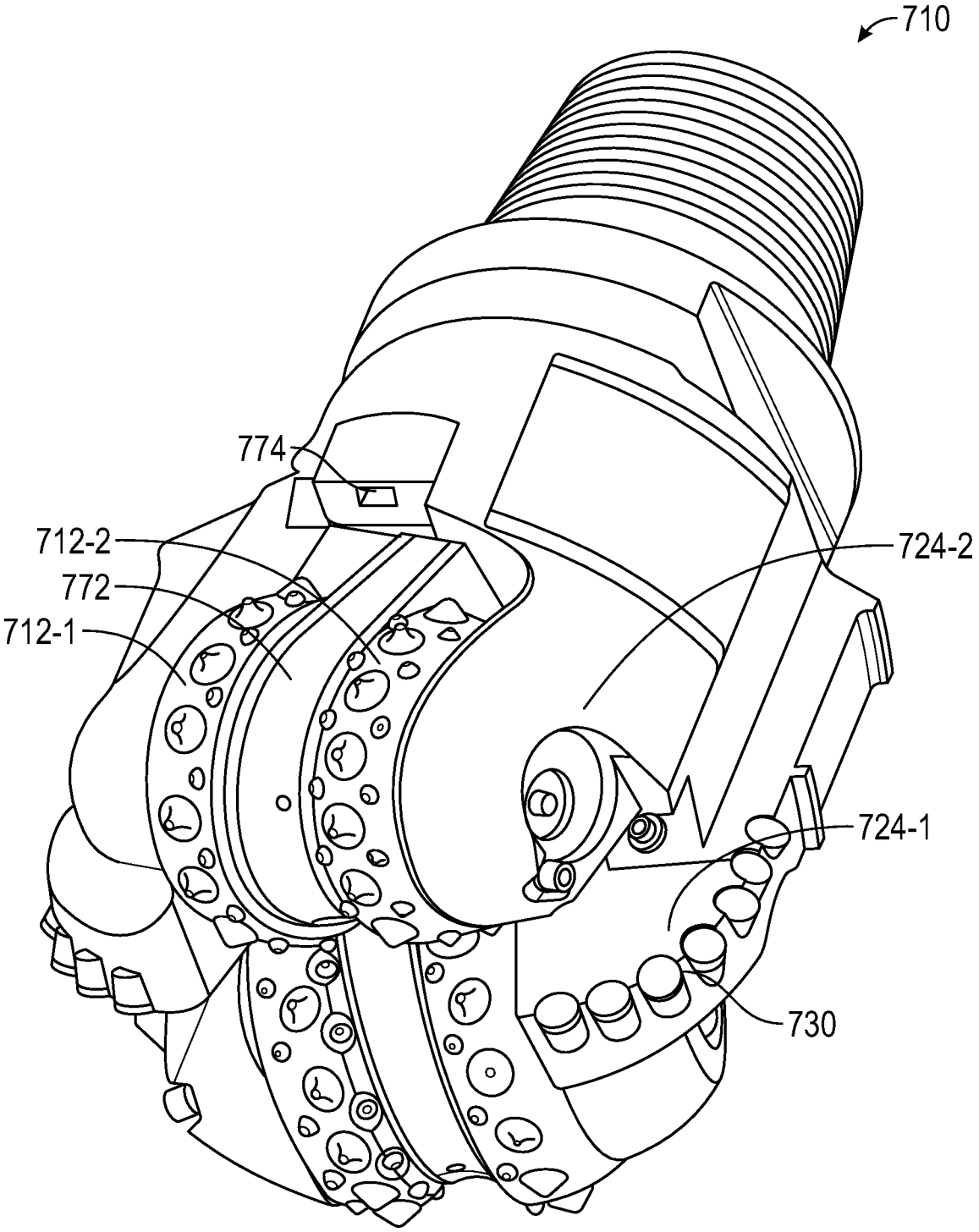
Figures 2, 7:
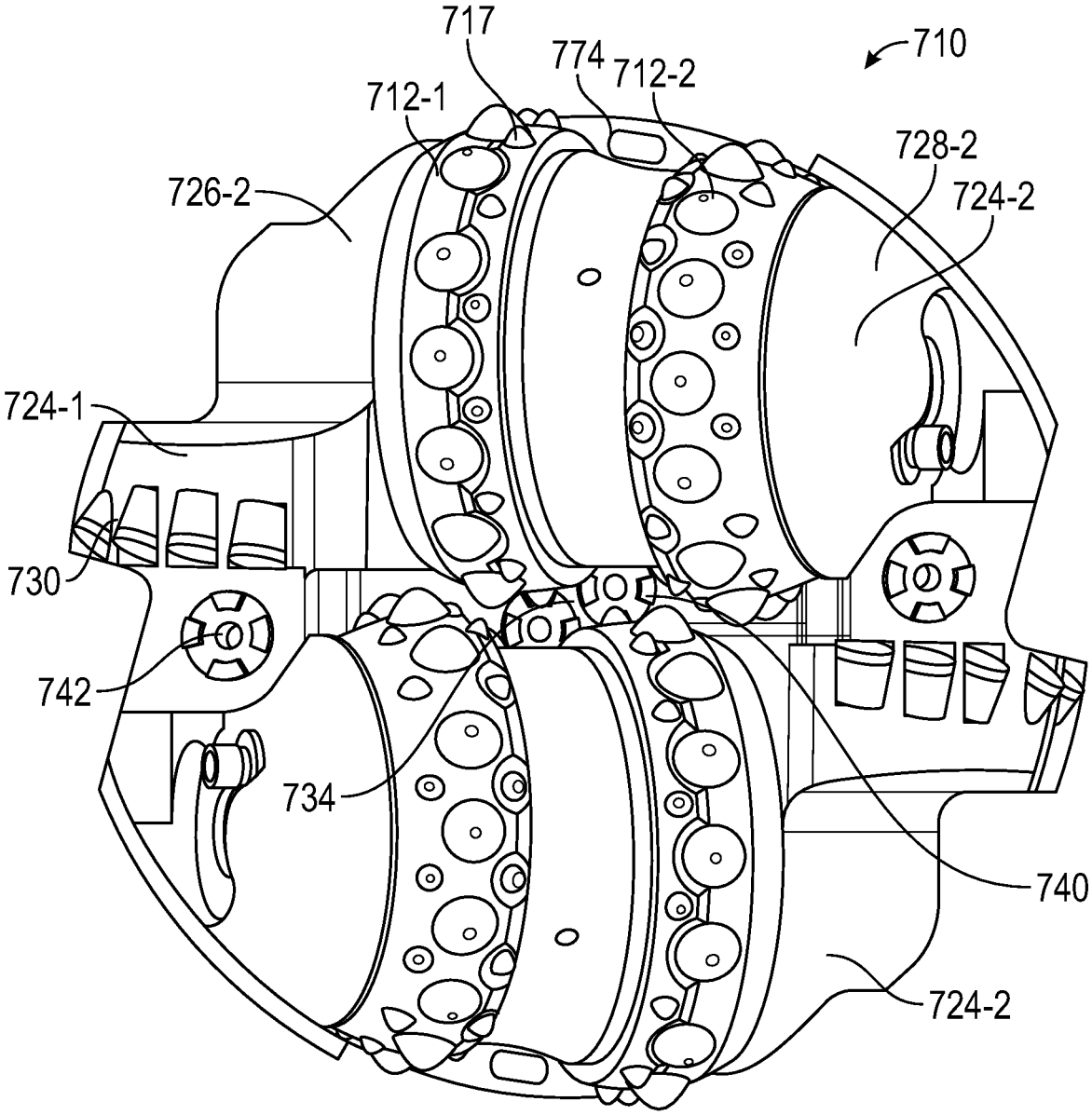
Figures 3, 7:
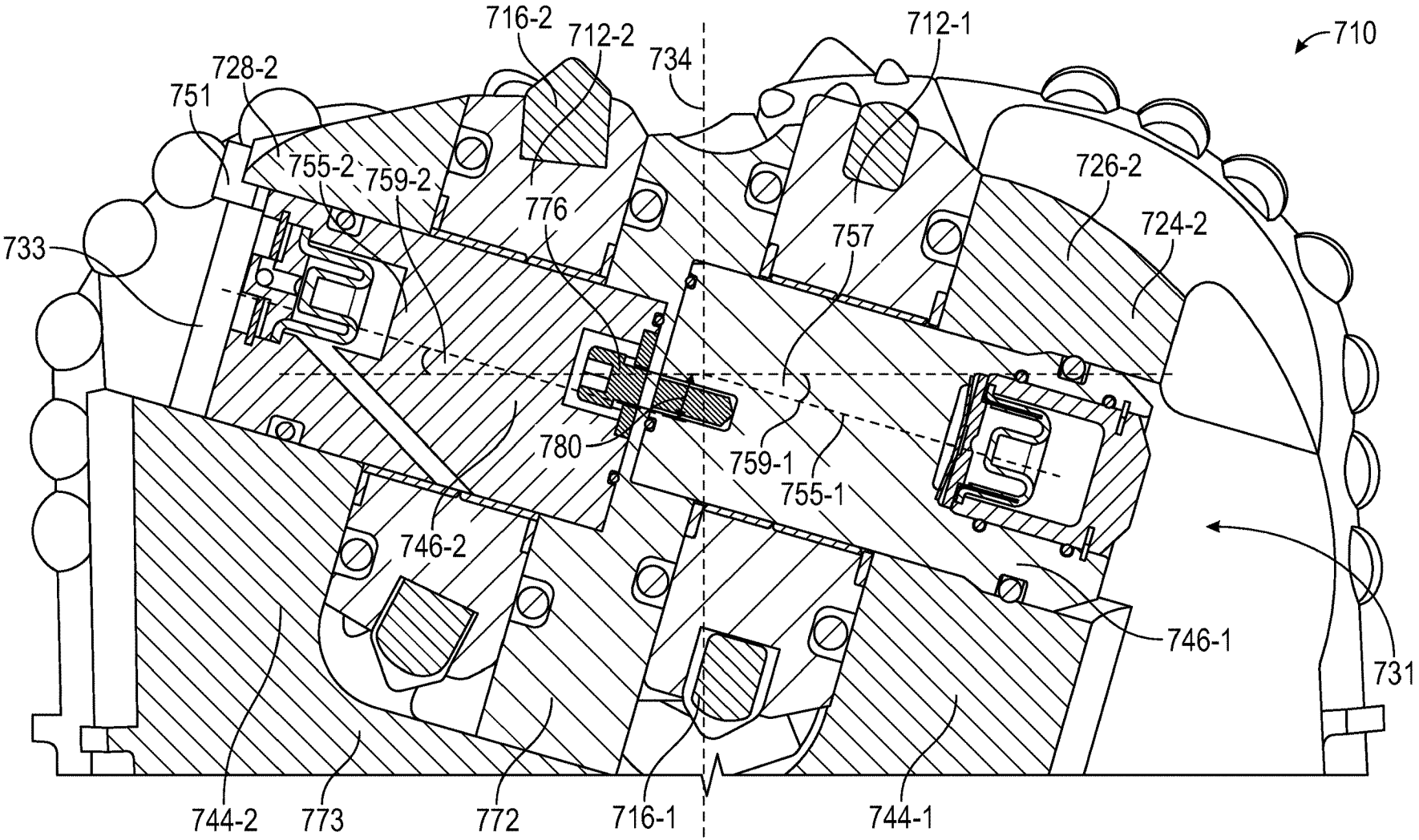
Figures 4, 7:
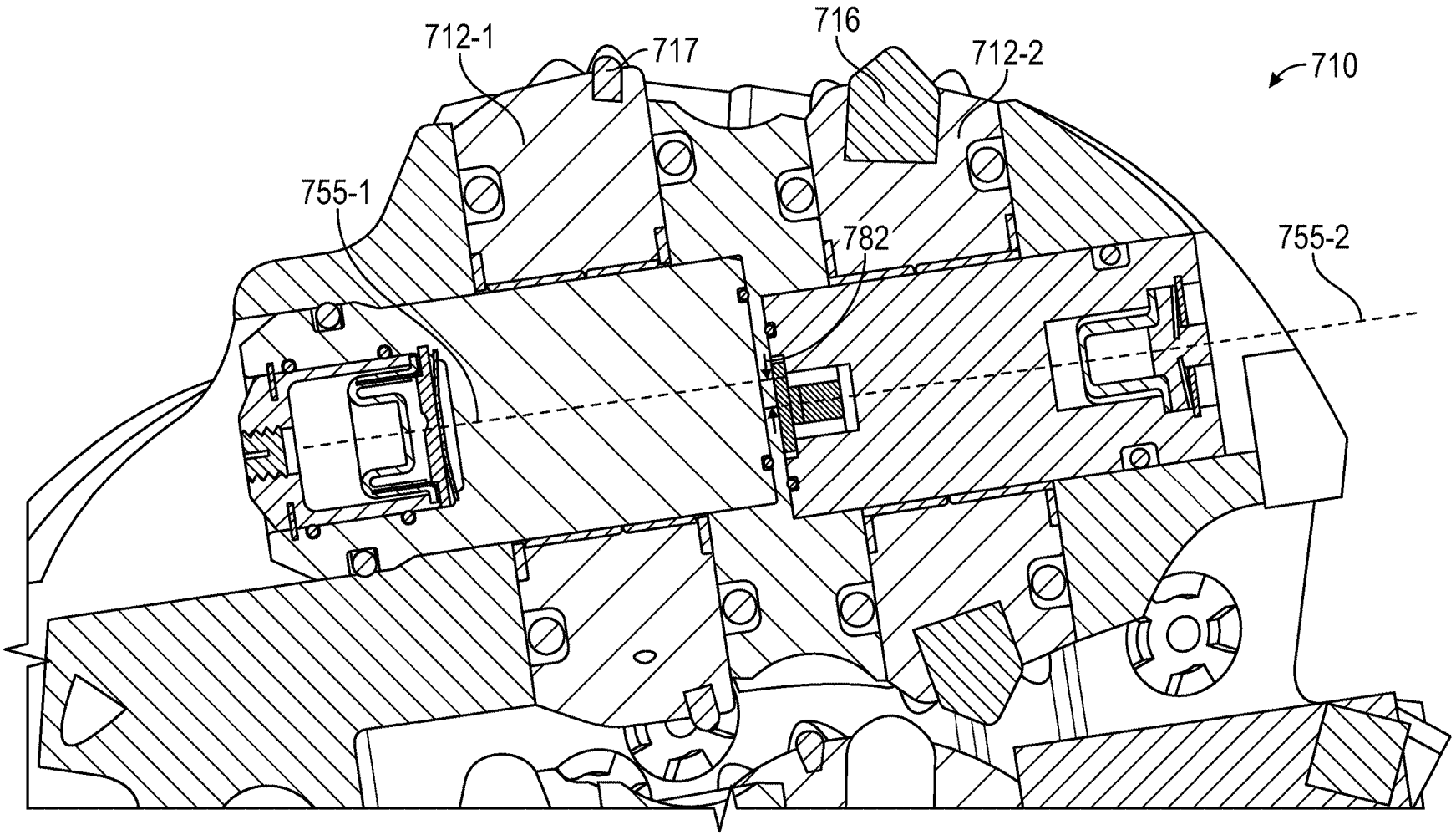
Figures 5, 7:
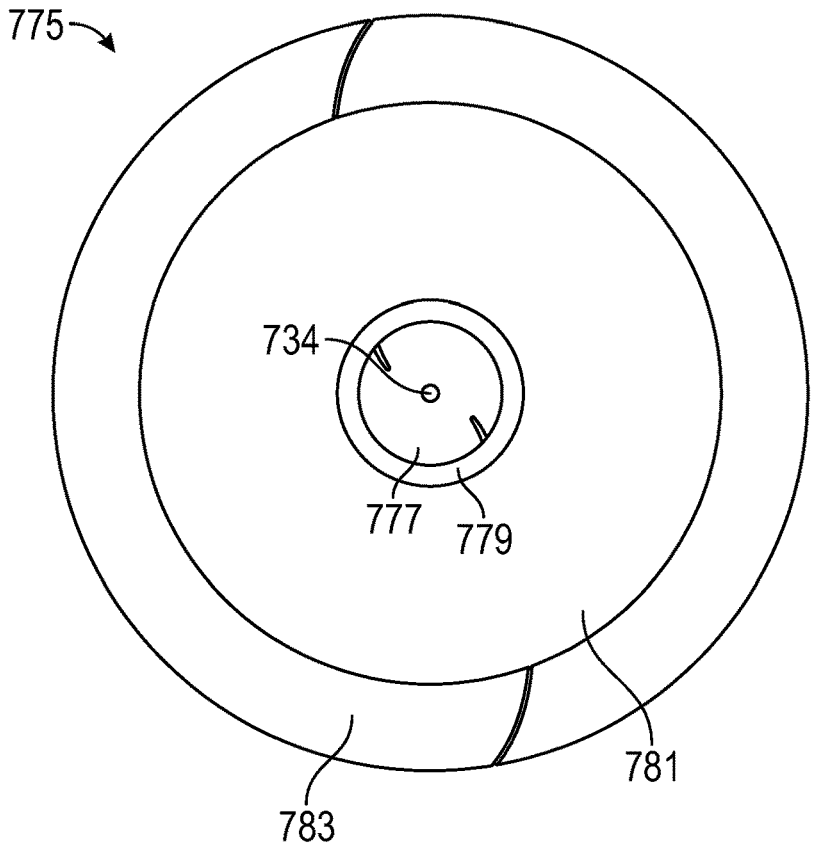

FIG. 7-1 is a perspective view of a bit 710, according to at least one embodiment of the present disclosure. The bit 710 may include at least some of the same features and characteristics as the rolling cutting structures and bits described in relation to FIG. 2-1 through FIG. 6. For example, the bit 710 may include two first blades 724-1 arranged opposite one another, and two second blades 724-2 arranged transverse to the first blades 724-1 and opposite each other. Each first blade 724-1 may include a fixed cutting structure 730. Each second blade 724-2 may include a first rolling cutting structure 712-1 and a second rolling cutting structure 712-2. The first rolling cutting structure 712-1 may be separated from the second rolling cutting structure 712-2 by a central support leg 772.

FIG. 7-2 is a bottom view of the bit 710 of FIG. 7-1. Each second blade 724-2 may include a second blade leading edge 726-2 and a second blade trailing edge 728-2. The first rolling cutting structure 712-1 may be located on the second blade leading edge 726-2 and the second rolling cutting structure 712-2 may be located on the second blade trailing edge 728-2.

The bit 710 may include one or more central fluid ports 740. The central fluid ports 740 may be located near the bit rotational axis 734 between second blades 724-2, and configured to flush cuttings away from the first rolling cutting structure 712-1 and the second rolling cutting structure 712-2. A blade nozzle 742 may be located on one or more of the first blades 724-1 and configured to clean and wash cutting away from the fixed cutting structures 730. An outer nozzle 774 may be located on an outer perimeter of the bit 710. The outer nozzle 774 may be configured to further clean the first rolling cutting structure 712-1 and the second rolling cutting structure 712-2.

FIG. 7-3 is a cross-sectional view of a second blade 724-2 of the bit 710 shown in FIGS. 7-1 and 7-2. The second blade 724-2 may support the first rolling cutting structure 712-1 at the second blade leading edge 726-2 and the second rolling cutting structure 712-2 at the second blade trailing edge 728-2. A first journal 746-1 may secure the first rolling cutting structure 712-1 to a first support leg 744-1 and the central support leg 772. A second journal 746-2 may secure the second rolling cutting structure 712-2 to a second support leg 744-2 and the central support leg 772.

In some embodiments, one or more of the first rolling cutting structure 712-1 and the second rolling cutting structure 712-2 may be angled relative to the bit rotational axis 734. For example, the first journal 746-1 may have a first journal axle axis 755-1, about which the first rolling cutting structure 712-1 may rotate. The second journal 746-2 may have a second journal axle axis 755-2, about which the second rolling cutting structure 712-2 may rotate. In some embodiments, the first journal axle axis 755-1 and the second journal axle axis 755-2 may be perpendicular to the bit rotational axis 734.

In other embodiments, the first journal axle axis 755-1 may be angled with a first journal angle 759-1 relative to a reference line 757, the reference line 757 being perpendicular to the bit rotational axis 734. Similarly, the second journal axle axis 755-2 may have a second journal angle 759-2 relative to the reference line 757. In some embodiments, the first journal angle 759-1 and the second journal angle 759-2 may have different signs. For example, the first journal angle 759-1 may be negative, and the second journal angle 759-2 may be positive. In other examples, the first journal angle 759-1 may be positive and the second journal angle 759-2 may be negative. In other embodiments, the first journal angle 759-1 and the second journal angle 759-2 may have the same sign. For example, the first journal angle 759-1 and the second journal angle 759-2 may both be positive. In other examples, the first journal angle 759-1 and the second journal angle 759-2 may both be negative.

As the bit 710 rotates, the rolling cutting structures 712-1, 712-2 may rotate about the journal axle axis 755-1, 755-2. In some embodiments, the rolling cutting structures 712-1, 712-2 may rotate from the bit rotational axis 734 to an outer perimeter of the bit 710. In other embodiments, the rolling cutting structures 712-1, 712-2 may rotate from the outer perimeter of the bit 710 to the bit rotational axis 734. In some embodiments, both the first rolling cutting structure 712-1 and the second rolling cutting structure 712-2 may rotate in the same direction (i.e., from the bit rotational axis 734 to the outer perimeter of the bit 710 or from the outer perimeter of the bit 710 to the bit rotational axis 734). In other embodiments, the first rolling cutting structure 712-1 may rotate in a different direction from the second rolling cutting structure 712-2. For example, the first rolling cutting structure 712-1 may rotate from the bit rotational axis 734 to the outer perimeter of the bit 710 and the second rolling cutting structure 712-2 may rotate from the outer perimeter of the bit 710 to the bit rotational axis 734. In another example, the first rolling cutting structure 712-1 may rotate from the outer perimeter of the bit 710 to the bit rotational axis 734 and the second rolling cutting structure 712-2 may rotate from the bit rotational axis 734 to the outer perimeter of the bit 710.

Rolling cutting structures 712-1, 712-2 that rotate in opposite directions, or counter-rotating rolling cutting structures 712-1, 712-2, may cut the formation in different ways, which may improve the rate of penetration of the bit 710, the life of the bit 710, and/or decrease maintenance of the bit 710. For example, first cutting elements 716-1 on the first rolling cutting structure 712-1 may cut a first path in a first direction in the formation. Second cutting elements 716-2 on the second rolling cutting structure 712-2 may cut a second path in a second direction in the formation. Because the second direction is different from the first direction, then the second cutting elements 716-2 may not engage the formation in the same furrows or divots left by the first cutting elements 716-1. This may reduce wear on the rolling cutting structures 712-1, 712-2. Further, the fracture patterns of the formation caused by the first rolling cutting structure 712-1 and the second rolling cutting structure 712-2 may be different. This may cause the formation to more easily break up and/or to break up into smaller pieces.

The second blade 724-2 may include a journal cavity 731. The journal cavity 731 may extend through the first support leg 744-1 and through at least a part of the second support leg 744-2. To install the rolling cutting structures 712-1, 712-2, the second journal 746-2 may be inserted through the second rolling cutting structure 712-2 and into the journal cavity 731 located in the second support leg 744-2. The second journal 746-2 may be secured to the central support leg 772. Then the first journal 746-1 may be inserted into the journal cavity 731 located in the first support leg 744-1, through the first rolling cutting structure 712-1, and secured to the central support leg 772. Therefore, the central support leg 772 may support one or both of the first rolling cutting structure 712-1 and the second rolling cutting structure 712-2.

In some embodiments, the first journal 746-1 and the second journal 746-2 may be independently secured to the central support leg 772. In other embodiments, a connector bolt 776 may pass through a portion of the central support leg 772. The connector bolt 776 may connect to both the first journal 746-1 and the second journal 746-2. As the connector bolt 776 is placed in tension, the first journal 746-1 and the second journal 746-2 may be drawn toward and secured against the central support leg. In some embodiments, the connector bolt 776 may be a screw with the head in a cavity of one journal and the threaded portion in a cavity including matching threads of the other journal. In other embodiments, the connector bolt 776 may be any type of mechanical connector.

In some embodiments, a bolt cavity 733 may be located in the second support leg 744-2. A threaded fastener 751 inserted into the bolt cavity 733 may secure the second journal 746-2 to the second support leg 744-2. Therefore, the first journal may be secured inside the journal cavity 731 by being connected to the central support leg 772 and the second journal 746-2 through the connector bolt 776.

In some embodiments, the central support leg 772 may be integrally formed with a bit body 773. In other words, the central support leg 772 may be formed as a single piece with the bit body 773. In other embodiments, the central support leg 772 may be formed separately and connected to the bit body 773. For example, the central support leg 772 may be connected to the bit body 773 by braze, weld, screw, bolt, interference fit (e.g., dovetail joint), friction fit, or other means of connection.

In some embodiments, the central support leg 772 may include one or more wear pads or hard facing located at a bottom of the central support leg 772. In this manner, the central support leg 772 may be protected from any portions of the formation that may not be cut by the rolling cutting structures 712-1, 712-2.

The first rolling cutting structure 712-1712-2 may have different exposures. In some embodiments, parameters of the first rolling cutting structure 712-1 and the second rolling cutting structure 712-2 may be changed to ensure that the first rolling cutting structure 712-1 and the second rolling cutting structure 712-2 have the same or approximately the same exposure.

In some embodiments, the first journal 746-1 may be coaxial with the second journal 746-2. In other words, the first journal axle axis 755-1 may be the same as, or coincide with, the second journal axle axis 755-2. In other embodiments, the first journal axle axis 755-1 may be different from, or offset from, the second journal axle axis 755-2, with a vertical axis offset 780. In some embodiments, the vertical axis offset 780 may be in a range having an upper value, a lower value, or upper and lower values including any of 0.1 in. (2.54 mm), 0.2 in. (5.08 mm), 0.3 in. (7.62 mm), 0.4 in. (10.16 mm), 0.5 in. (12.70 mm), 0.6 in. (15.24 mm), 0.7 in. (17.78 mm), 0.8 in. (20.32 mm), 0.9 in. (22.86 mm), 1.0 in. (25.40 mm), 1.5 in. (38.1 mm), 2 in. (50.8 cm), or any value therebetween. For example, the vertical axis offset 780 may be greater than 0.1 in. (2.54 mm). In another example, the vertical axis offset 780 may be less than 2.0 in. (50.8 mm). In yet other examples, the vertical axis offset 780 may be any value in a range between 0.1 in. (2.54 mm) and 2.0 in. (50.8 mm). The vertical axis offset 780 may therefore wholly or in part counteract the difference in exposure between the first rolling cutting structure 712-1 and the second rolling cutting structure 712-2.

In some embodiments, the first rolling cutting structure 712-1 may have the same wheel diameter (e.g., wheel diameter 220 of FIG. 2-2) as the second rolling cutting structure 712-2. In other embodiments, the first rolling cutting structure 712-1 may have a different wheel diameter as the second rolling cutting structure 712-2. In some embodiments, the second rolling cutting structures 712-2 may have a wheel diameter that is a percent of the first rolling cutting structure 712-1. In some embodiments, the percentage may be in a range having an upper value, a lower value, or upper and lower values including any of 50%, 60%, 70%, 75%, 80%, 85%, 90%, 95%, 100%, 105%, 110%, 115%, 120%, 125%, 130%, 140%, 150%, or any value therebetween. For example, the percentage may be greater than 50%. In another example, the percentage may be less than 150%. In yet other examples, the percentage may be any value in a range between 50% and 150%. Changing the wheel diameter may therefore wholly or in part counteract the difference in exposure between the first rolling cutting structure 712-1 and the second rolling cutting structure 712-2.

FIG. 7-4 is a bottom-up cross-sectional view of the bit 710 of FIGS. 7-1, 7-2, and 7-3. In some embodiments, the first journal axle axis 755-1 and the second journal axle axis 755-2 may be coaxial, or may share a common axis. In other embodiments, the first journal axle axis 755-1 may be offset from the second journal axle axis 755-2 with a radial axis offset 782. In some embodiments, the radial axis offset 782 may be in a range having an upper value, a lower value, or upper and lower values including any of 0.1 in. (2.54 mm), 0.2 in. (5.08 mm), 0.3 in. (7.62 mm), 0.4 in. (10.16 mm), 0.5 in. (12.70 mm), 0.6 in. (15.24 mm), 0.7 in. (17.78 mm), 0.8 in. (20.32 mm), 0.9 in. (22.86 mm), 1.0 in. (25.40 mm), or any value therebetween. For example, the radial axis offset 782 may be greater than 0.1 in. (2.54 mm). In another example, the radial axis offset 782 may be less than 1.0 in. (25.40 mm). In yet other examples, the radial axis offset 782 may be any value in a range between 0.1 in. (2.54 mm) and 1.0 in. (25.40 mm). The radial axis offset 782 may therefore wholly or in part counteract the difference in exposure between the first rolling cutting structure 712-1 and the second rolling cutting structure 712-2. While described in reference to FIG. 7-4, this offset difference may also apply to the other embodiments described herein, where the rolling cutting structures are located on different blades.

FIG. 7-5 is an embodiment of a cutting profile 775, according to at least one embodiment of the present disclosure. Different regions along the cutting profile 775 may be primarily cut by different cutting elements. In other words, different cutting elements may have the highest exposure along different regions of the cutting profile 775. In the embodiment shown in FIG. 7-5, a central first region 777 may be cut primarily by secondary cutting elements on the rolling cutting structures (e.g., the secondary cutting elements 717 of the rolling cutting structures 712-1, 712-2 shown on FIG. 7-2). The secondary cutting elements may be added to a rolling cutting structure specifically to cut this central first region 777, because otherwise the primary cutting elements (e.g., the first cutting elements 716-1 of FIG. 7-3) may not cut, or may not cut sufficiently, the central first region 777.

A second region 779 may be cut primarily by primary cutting elements of a second rolling cutting structure (e.g., the first cutting elements 716-1 of the second rolling cutting structure 712-2 of FIG. 7-3). A third region 781 may be cut primarily by primary cutting elements of a first rolling cutting structure (e.g., the primary cutting elements 716-1 of the first rolling cutting structure 712-1 of FIG. 7-3.). As may be seen, in some embodiments, the third region 781 may include the "nose" region of a bit. Thus, the primary cutting elements of the first rolling cutting structure may remove the largest amount of material. An outermost fourth region 783 may be cut by fixed cutting elements of a fixed cutting structure (e.g., fixed cutting structure 730 of FIG. 7-2). This outermost fourth region 783 may include the "shoulder" and/or the "gauge" region of a bit. As discussed above with FIG. 3-4, the nose region 781 may be cut by fixed cutting elements of the fixed cutting structure 730 and/or by the primary cutting elements of the rolling cutting structures 712.

As may be seen, one primary rolling cutting structure may have the largest cutting load. However, the remaining cutting structures may support the rolling cutting structure. Specifically, the remaining cutting structures may primarily cut sections of the formation that the primary rolling cutting structure may not be able to sufficiently reach.

Figure 8:
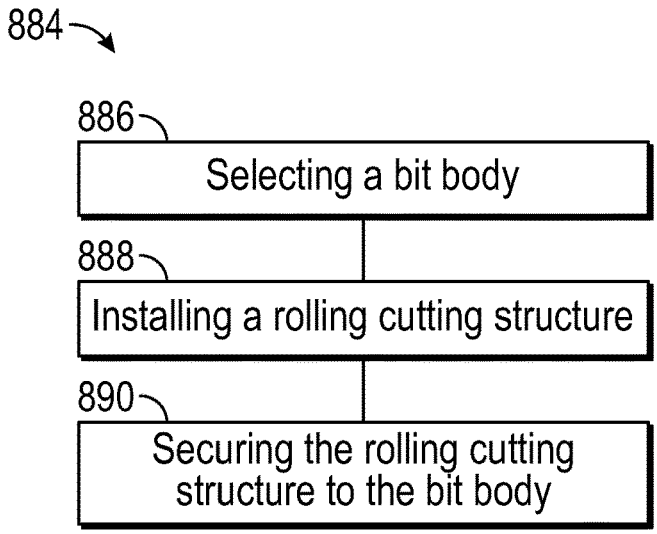
FIG. 8 is a method chart, according to at least one embodiment of the present disclosure.

FIG. 8 is a method chart for a method 884 of forming a drill bit, according to at least one embodiment of the present disclosure. The method 884 may include selecting a bit body at 886. Selecting the bit body may include selecting a bit body having a specific geometry. The geometry may include one or more fixed cutting structures, one or more rolling cutting structures, and so forth. In some embodiments, selecting the bit body may include forming the bit body. For example, the bit body may be cast, machined, or manufactured using additive manufacturing. The bit body may be a matrix body, a steel body, an additively manufactured body, or any combination thereof. In other examples, selecting the bit body may include selecting the design of a bit body and manufacturing the bit body or having a third party manufacture the bit body.

The method 884 may include installing a rolling cutting structure at 888. Installing the rolling cutting structure may include inserting the rolling cutting structure into a rolling cavity in the bit body and inserting a journal into a journal cavity in the bit body. Installing the rolling cutting structure may also include arranging with the journal any seals, sleeves, washers, or bearings, or any combination thereof. As described above, the journal and the sleeves may be selected and installed to adjust the exposure of the cutting elements of the rolling cutting structure.

The method may further include securing the rolling cutting structure to the bit body at 890. Securing the rolling cutting structure to the bit body may include securing the journal to the bit body. Securing the journal to the bit body may include securing the journal to the trailing edge of a blade. Securing the journal to the bit body may further include securing the journal to a support leg of the blade and the main body of the blade.

The embodiments of the hybrid bit have been primarily described with reference to wellbore drilling operations; the hybrid bit described herein may be used in applications other than the drilling of a wellbore. In other embodiments, hybrid bits according to the present disclosure may be used outside a wellbore or other downhole environment used for the exploration or production of natural resources. For instance, hybrid bits of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A hybrid bit comprising:

a fixed cutting structure including a plurality of fixed cutting elements the fixed cutting structure having a journal cavity;

a first rolling slot within the fixed cutting structure, the rolling slot having a plurality of sleeves disposed on either side of the rolling slot such that a portion of each of the plurality of sleeves abuts against an inner surface of the rolling slot and wherein each of the plurality of sleeves extends partially into the journal cavity, and a rolling cutting structure coupled to the fixed cutting structure within the rolling slot such that the plurality of sleeves are configured to support the rolling cutting structure, the rolling cutting structure comprising:

a journal bore extending through the rolling cutting structure;

a radially outer surface;

a plurality of cutting elements extending from the radially outer surface of the rolling cutting structure.

2. The hybrid bit of claim 1, further comprising a blade, the blade including a leading edge, a trailing edge, and wherein the first rolling slot is between the leading edge and the trailing edge, the fixed cutting structure being located on the leading edge and the rolling cutting structure being located on the trailing edge, wherein the rolling cutting structure is inserted into the rolling slot, the trailing edge includes a support leg, and the rolling cutting structure is supported by the leading edge and the support leg.

3. The hybrid bit of claim 2, wherein the leading edge of the blade comprises an upper blade section of the fixed cutting structure having a first set of fixed cutting elements of the plurality of fixed cutting elements, and the support leg of the trailing edge comprises a lower blade section of the fixed cutting structure having a second set of fixed cutting elements of the plurality of fixed cutting elements.

4. The hybrid bit of claim 1, wherein the fixed cutting structure comprises a first blade between a first leading edge and a first trailing edge and a second blade having a second rolling slot between a second leading edge and a second trailing edge, and the rolling cutting structure comprises a first rolling cutting structure arranged in the first rolling slot and a second rolling cutting structure arranged in the second rolling slot, wherein the first rolling slot and the second rolling slot are open to a central cavity of the hybrid bit.

5. The hybrid bit of claim 1, further comprising a first set of blades and a second set of blades, the first set of blades including the rolling cutting structure, the second set of blades including the fixed cutting structure, a secondary blade of the second set of blades being located on either side of each first blade of the first set of blades.

6. The hybrid bit of claim 1, the rolling cutting structure being configured to rotate about a journal axle axis, a reference line perpendicular to a bit rotational axis extending a roller offset from the bit rotational axis to the journal axle axis, a reference circle being centered on the bit rotational axis with a radius equal to the roller offset, a tangent line being tangent to the reference circle at the journal axle axis, a journal axle orientation angle between the journal axle axis and the tangent line being 45° or less.

7. The hybrid bit of claim 1, the rolling cutting structure including a roller offset of greater than or equal to 20% of a bit diameter.

8. The hybrid bit of claim 1, further comprising a central fluid port, the central fluid port being located at approximately a center of the hybrid bit.

9. The hybrid bit of claim 1, the plurality of cutting elements being attached to the rolling cutting structure such that a cutting element axis is approximately perpendicular to a journal axle axis of the rolling cutting structure.

10. The hybrid bit of claim 1, an attachment angle of the plurality of cutting elements being 17° between a cutting element axis and a plane normal to the bit axis.

11. The hybrid bit of claim 1, further comprising a journal angle of the rolling cutting structure the journal angle being within 5° of 17° of a rotational axis of the hybrid bit.

12. The hybrid bit of claim 1, an outermost perimeter of the plurality of cutting elements rotating to within 0.25 in. of a bit rotational axis.

13. The hybrid bit of claim 1, an outermost perimeter of the plurality of cutting elements rotating beyond a bit rotational axis.

14. The hybrid bit of claim 1, the plurality of cutting elements being on the leading edge of a line which lies perpendicular to a bit rotational axis and perpendicular to a journal axle axis at a bottom-most rotation of the rolling cutting structure.

15. A bit comprising:

a fixed cutting structure including a plurality of fixed cutting elements and a journal cavity disposed in the fixed cutting structure, wherein the fixed cutting structure comprises a first blade having a first rolling slot between a first leading edge and a first trailing edge, and a second blade having a second rolling slot between a second leading edge and a second trailing edge, wherein the first rolling slot and the second rolling slot are open to a central cavity of the bit comprising a central fluid port;

wherein each of the first and second rolling slots each have a plurality of sleeves disposed on either side of the first and second rolling slots such that a portion of each of the plurality of sleeves abuts against an inner surface of each of the first and second rolling slots and wherein each of the plurality of sleeves extends partially into the journal cavity and a rolling cutting structure including a plurality of cutting elements, the rolling cutting structure comprising a first rolling cutting structure arranged in the first rolling slot such that a portion of the plurality of sleeves are configure to support the first rolling structure and a second rolling cutting structure arranged in the second rolling slot such that another portion of the plurality of sleeves are configured to support the second rolling structure, wherein each of the rolling cutting structures is wheel-shaped with a journal bore extending through the respective rolling cutting structure, the plurality of cutting elements being located on a radially outer surface of each of the rolling cutting structures.

16. The bit of claim 15, the rolling cutting structure having an adjustable height.

17. The bit of claim 15, the plurality of cutting elements including a first row of cutting elements and a second row of cutting elements on the first rolling cutting structure, and the plurality of cutting elements including a third row of cutting elements and a fourth row of cutting elements on the second rolling cutting structure.

18. A method of forming a hybrid drill bit, comprising:

selecting a bit body, wherein the bit body comprises:

a first fixed cutting structure including a first journal cavity and having a first fixed cutting element disposed on a first leading edge of the first fixed cutting structure;

a first rolling slot between the first leading edge and a first trailing edge of the first fixed cutting structure;

a second fixed cutting structure having a second journal cavity and including a second fixed cutting element disposed on a second leading edge of the second leading cutting structure;

a second rolling slot between the second leading edge and a second trailing edge of the second fixed cutting structure;

a central cavity of the bit body open to the first slot and the second slot, the central cavity comprising a central fluid nozzle;

a first rolling cutting structure comprising a first plurality of cutting elements extending in a first radial direction from a first outer surface of the first rolling cutting structure, wherein the first rolling cutting structure is wheel-shaped; and a second rolling cutting structure comprising a second plurality of cutting elements extending in a second radial direction from a second outer surface of the second rolling cutting structure, wherein the second rolling cutting structure is wheel-shaped; and installing the first rolling cutting structure in the first rolling slot, comprising:

arranging a first plurality of sleeves between the first rolling cutting structure and the first fixed cutting structure in the first rolling slot such that the first plurality of sleeves are positioned on either side of the first rolling slot and a portion of the plurality of sleeves abuts an inner surface of the first rolling slot and wherein the first plurality of sleeves extends partially into the first journal cavity; and inserting a first journal through the first plurality of sleeves, the first journal cavity, the first rolling cutting structure, and the first slot;

installing the second rolling cutting structure in the second slot, comprising:

inserting a second journal through the second plurality of sleeves, the second journal cavity, the second rolling cutting structure, and the second rolling slot;

arranging a second plurality of sleeves between the second rolling cutting structure and the second fixed cutting structure in the second rolling slot such that the second plurality of sleeves are positioned on either side of the second rolling slot and a portion of the second plurality of sleeves abuts an inner surface of the second rolling slot and wherein the second plurality of sleeves extend partially into the second journal cavity; and securing the first rolling cutting structure and the second rolling cutting structure to the bit body.

19. The method of claim 18, wherein installing the first rolling cutting structure in the first slot comprises selecting the first plurality of sleeves to adjust an exposure of the first plurality of cutting elements of the first rolling cutting structure.

20. The method of claim 18, wherein the first journal comprises a first reservoir configured to supply a first lubricant to the first rolling cutting structure and the second journal comprises a second reservoir configured to supply a second lubricant to the second rolling cutting structure.

* * * * *